US005757927A

United States Patent [19]

Gerzon et al.

[11] Patent Number: 5,757,927

[45] Date of Patent: May 26, 1998

[54] SURROUND SOUND APPARATUS

[75] Inventors: Michael Anthony Gerzon, Oxford; Geoffrey James Barton, Herts, both of United Kingdom

[73] Assignee: Trifield Productions Ltd., London, England

[21] Appl. No.: 904,440

[22] Filed: Jul. 31, 1997

Related U.S. Application Data

[63] Continuation of Ser. No. 302,666, PCT/GB93/00042 filed on Mar. 2, 1993.

[30] Foreign Application Priority Data

Mar. 2, 1992 [GB] United Kingdom ..... 92044853

[51] Int. Cl.[6] ..... H04R 5/00

[52] U.S. Cl. ..... 381/20; 381/19; 381/18

[58] Field of Search ..... 381/18, 19, 21, 381/22, 17

[56] References Cited

U.S. PATENT DOCUMENTS

| | | | |
|---|---|---|---|
| 3,997,725 | 12/1976 | Gerzon | 381/21 |
| 4,081,606 | 3/1978 | Gerzon | 381/19 |
| 4,086,433 | 4/1978 | Gerzon | 381/21 |
| 4,151,369 | 4/1979 | Gerzon . | |
| 4,414,430 | 11/1983 | Gerzon | 381/22 |
| 4,704,728 | 11/1987 | Scheiber . | |

FOREIGN PATENT DOCUMENTS

WO 91/19407 12/1991 WIPO .

OTHER PUBLICATIONS

"Optimum Reproduction Matrices for Multispeaker Stereo" by Michael A. Gerzon, AES Journal of the Audio Engineering Society.

*Primary Examiner*—Minsun Oh Harvey
*Attorney, Agent, or Firm*—Baker & Daniels

[57] ABSTRACT

A surround sound apparatus wherein a decoder decodes directionally encoded audio signals for reproduction via a loudspeaker layout over a listening area wherein the signals are decoded by a matrix. The coefficients of the decoding matrix are such that at a predetermined listening position, the reproduced velocity vector direction and the reproduced energy vector position directions are substantially equal to each other and substantially independent of frequency in a broad audio frequency range The gain coefficients of the decoding matrix are such that the reproduced velocity vector magnitude varies systematically with encoded sound direction at frequencies in the region of and above a predetermined middle audio frequency.

39 Claims, 10 Drawing Sheets

SURROUND SOUND APPARATUS

This is a continuation of application Ser. No. 08/302,666, filed as PCT/GB93/00042, on Mar. 2, 1993.

FIELD OF INVENTION

The present invention relates to techniques for directionally encoding and reproducing sound, and particularly, but not exclusively, to the technique known as surround sound and to the provision of improved surround sound decoders and reproduction systems using such decoders.

The present invention is applicable to a number of different surround sound techniques, including Ambisonics, and to other encoding techniques.

BACKGROUND TO THE INVENTION

Ambisonics was developed in the 1970's and early 1980's based on the idea of encoding information about a 360° directional surround-sound field within a limited number of recording or transmission channels, and decoding these through a frequency-dependent psychoacoustically optimised decoder matrix. The matrix is adapted to the specific arrangement of loudspeakers in the listening room, so as to recreate through that specific layout the directional effect originally intended. Examples of Ambisonic systems are described and claimed in the earlier British patents numbers 1494751, 1494752, 1550627 and 2073556, all assigned to National Research Development Corporation. Ambisonic techniques are also described in a number of published papers including the paper by M. A. Gerzon, "Ambisonics in Multichannel Broadcasting and Video" published at pp 859–871 of J Audio Eng. Soc., Vol. 33, No. 11, (1985 November).

While known Ambisonic systems have worked extremely well, particularly in those cases where at least three transmission channels are available, they do nonetheless, in common with many other sound reproduction systems, suffer some limitations particularly with respect to the stability of front-stage images. This is a marked disadvantage in particular when it is desired to use Ambisonics in an audiovisual system with TV, film or HDTV. Then it is found that the stability of front-stage images is not good enough to give a reasonable match in direction between the audible and visual image across the whole listening area.

SUMMARY OF THE INVENTION

According to a first aspect of the present invention, there is provided a decoder for decoding directionally encoded audio signals for reproduction via a loudspeaker layout over a listening area, comprising:

an input for receiving the directionally encoded audio signals;

matrix means for modifying said audio signals; and an output for outputting the modified audio signal in a form suitable for reproduction via the loudspeakers;

the coefficients of said matrix means being such that at a predetermined listening position in the listening area the reproduced velocity vector direction and the reproduced energy vector directions are substantially equal to each other and substantially independent of frequency in a broad audio frequency range, characterised in that the gain coefficients of said matrix means are such that the reproduced velocity vector magnitude $r_v$ of a decoded audio signal varies systematically with encoded sound direction at frequencies in the region of and above a predetermined middle audio frequency.

According to another aspect of the present invention, there is provided a surround sound decoder including matrix decoding means for decoding a signal having pressure-related and velocity-related components thereby providing output signals representing feed signals for a plurality of loudspeakers, in which the values of the coefficients of the matrix decoding means are such that the magnitude $r_v$ of the real part of the ratio of the reproduced velocity vector gain to the reproduced pressure gain varies with azimuthal direction at at least some frequencies.

Preferably the decoder is an Ambisonic decoder.

The velocity vector having magnitude $r_v$, energy vector having magnitude $r_E$ and pressure signal P are formally defined and discussed in relation to the Ambisonic decoding equations in the detailed description and theoretical analysis below.

In all the prior art Ambisonic decoders, a decoding matrix has been used which is frequency-dependent so as to ensure that $r_v$ equals 1 at low frequencies and that $r_E$ was larger at high frequencies. In all such matrices the velocity vector had a magnitude which was substantially constant for all directions and the pressure signal P had exactly the same directional gain pattern (as a function of encoded azimuth θ) at low and high frequencies, apart from a simple adjustment of overall gain with frequency. The present invention, by contrast, provides an Ambisonic decoder arranged to satisfy the Ambisonic decoding equations in the case where the $r_v$ varies with azimuth, and, preferably, the directional gain pattern of the pressure signal P varies with frequency. Typically, for decoders having better front-stage than back-stage image stability, the back-sound gain divided by front-sound gain for the pressure signal will have a smaller value at low frequencies (for which $r_v$ typically equals 1) than at higher frequencies (for which typically $r_E$ is maximised with a greater value for front- stage sounds than for back-stage sounds).

The present inventors have recognised that the directional gain pattern of the pressure signal P (which for layouts of speakers at identical distances is the sum of the speaker feed signals) can be varied with frequency while still giving solutions of the Ambisonic decoding equations and that this gives an extra degree of freedom which may be used to optimise the performance of the Ambisonic decoder. In particular, it is found to be advantageous to make $r_v$ vary substantially with encoding azimuth θ rather than to be substantially constant with azimuth as it was in the prior art Ambisonic decoders. This is particularly important in improving the stability of images. It is found that the degree of image movement with lateral movement of the listener is proportional to $1-r_E$, so that the greater the value of $r_E$ the less the movement and hence the greater the image stability. It is also found that the value of $r_E$ tends to be maximised when $r_E$ substantially equals $r_v$. $r_E$ varies with the encoding azimuth and so it is found that the best performance is obtained by having $r_v$ also vary with encoding azimuth so as to track the value of $r_E$ in so far as this is possible. In general $r_E$ varies with direction with higher harmonic components than $r_v$ so that only rarely can $r_E$ and $r_v$ have exactly the same values for all azimuths. Nonetheless it is found that fairly close matching of the two quantities generally gives improved high frequency results.

Preferably the encoded directional signal is modified to increase the relative gains of sounds in those directions in which the magnitude $r_E$ of the reproduced energy vector is largest.

A further property of Ambisonic decoder systems which hitherto has tended to degrade image stability, is the fact that overall reproduced energy gain E tends to be largest when $r_E$ is smallest and vice-versa. It is therefore advantageous if as well as maximising $r_E$ in a desired direction in accordance with the first aspect of this invention, the gain is modified in a complementary fashion to counter the loss in energy gain which would otherwise occur. In general, such modifications will alter the reproduced azimuth so that it no longer equals the encoded azimuth θ but such modifications in practice will not be so large as to introduce gross directional distortions in the reproduced sound image. Moreover, it is found that even if the reproduced azimuth does not exactly equal the encoded azimuth nonetheless frequency-dependent image smearing can be avoided as long as the decoded azimuth does not vary substantially with frequency (at least up to around 3½ kHz).

According to a second aspect of the present invention, an Ambisonic decoder including decoder matrix means arranged to decode a signal having components W, X, Y where W is a pressure-related component and X and Y are velocity-related components, as herein defined, the matrix decoding means producing thereby output signals representing loudspeaker feeds for a plurality of loudspeakers, further comprises transformation means arranged to apply a transformation to the signal components W, X, Y thereby generating transformed components W', X', Y' for decoding by the decoding matrix means.

The transformation may be a Lorentz transformation.

As described in greater detail below, the sound field is preferably encoded using the so called B-format. B-format encodes horizontal sounds into three signals, W, X and Y where W is an omnidirectional signal encoding sounds from all azimuths with equal gains equal to 1 and X and Y correspond to figure-of-eight polar diagrams with maximum gains √2 aligned with the orthogonal X and Y axes respectively. This format is shown in FIG. 2. These signals have the property that for sound from any given direction θ the relationship $$2W^2=X^2+Y^2 \quad (2)$$

applies. The present inventors have recognised that by applying to the original encoded W, X and Y signals a transformation of the class known as Lorentz transformations, signals W', X', Y' result which still satisfy the relationship given above. This enables manipulation of the signal while retaining the Ambisonic properties. B-format can also be extended to full-sphere directional signal by adding a fourth upward-pointing 2 figure-of-eight signal as shown in FIG. 3. Although for clarity this aspect of the invention is described in relation to encoding in the horizontal plane it also encompasses such full-sphere W,X, Y,Z encoding. Similarly the other aspects of the invention are also applicable to full-sphere encoding.

Preferably the Lorentz transformation means are arranged to apply a forward dominance transformation.

One particular Lorentz transformation termed by the inventor the "forward dominance" transformation, and defined in detail below, has the effect of increasing front sound gain by a factor λ while altering the rear sound gain by an inverse factor 1/λ. A forward dominance transformation is particularly valuable with decoders in accordance with the first aspect of the invention, since as noted above such decoders can otherwise give excessive gains for rear sounds.

According to a third aspect of the present invention, in a surround sound decoder include decoder matrix means arranged to decode a signal and provide output signals corresponding to a plurality of loudspeaker feed signals, the decoder is arranged to output signals representing feed signals for an arrangement of loudspeakers surrounding a listener position comprising at least two pairs of loudspeakers disposed symmetrically to the two sides of the listener position and for at least one further loudspeaker positioned between one of the said pairs of loudspeakers. Preferably the decoder is an Ambisonic decoder.

Preferably the at least one further loudspeaker is positioned centrally between the two front-stage loudspeakers.

It has long been known that the use of an additional central loudspeaker to supplement the two loudspeakers for the front stage can enhance considerably the stability of front-stage images. In view of this, proposed standards for HDTV sound invariably incorporate at least one such central loudspeaker in addition to a stereo pair. However, hitherto it has only been possible to find Ambisonic decoder solutions for highly symmetrical, e.g. rectangular or hexagonal, layouts. The present inventor however have found a solution for decoders suitable for a less symmetric layout incorporating one or more central loudspeakers. There are listed in further detail below solutions for different 5 and 6 speaker layouts together with a general procedure for finding other such solutions.

According to a further aspect of the present invention, there is provided an Ambisonic decoder including matrix decoding means for decoding a signal having pressure-related and velocity-related components and thereby providing output signals representing feed signals for a plurality of loudspeakers, in which the values of the coefficients of the matrix decoding means are such that the directional gain pattern of the pressure-related component P of the reproduced signal is different at different frequencies, the decoder not being a 2.5 channel Ambisonic decoder responsive to 3-channel surround sound at some audio frequencies and to a 2-channel surround sound at some other frequencies.

According to a further aspect of the present invention there is provided a decoder including an Ambisonic decoder according to any one of the preceding aspects, and further comprising means for decoding a supplementary channel E, thereby providing improved stability of and separation between the front and rear stages.

According to a further aspect of the present invention there is provided a decoder including an Ambisonic decoder according to any one of the preceding aspects, and further comprising means for decoding a supplementary channel F thereby providing a further output signal for use in cancelling crosstalk between front and rear stages.

Preferably E is encoded with gain $k_e(1-c_e(1-\cos\theta))$ for $|\theta|<\theta_s$ and gain 0 for $|\theta|>\theta_s$ and F encoded with gains $2^{1/2}k_f\sin\theta$ for $|\theta|\leqq\theta_s$, gains $-2^{1/2}k_b\sin\theta$ for $|180°-\theta|\leqq\theta_B$ and gain 0 for other θ, where $\theta_s$ is the half-width of a frontal stage which may typically be 60°, $\theta_B$ is the half-width of a rear stage which may typically be 70°, and $k_e$, $k_f$ and $k_b$ are gain constants which may be chosen between 0 (for pure B-format) and a value equal to or in the neighbourhood of 1 (for reproduction effect purely in front and rear stages). Preferably $c_e$ lies between substantially 3 and 3.5 and more preferably is equal to substantially 3.25.

This aspect of the present invention provides a decoder which gives a further improvement in frontal-stage image stability. While the Ambisonic decoders of the preceding aspects of the present invention in themselves give a significant improvement in stability even greater stability may still be desirable when, for example, the decoder is to be used in an HDTV system. The present inventor has found that by adding at least one additional channel signal E to provide a feed for a centre-front loudspeaker, a system results which offers much of the image stability attainable with the three or four-speaker frontal stereo systems known in the art, while retaining the flexibility of the Ambisonic decoders in providing optimally decoded results via a variety of speaker layouts. Moreover, it is found that the 5 or 6-speaker Ambisonic decoders of the present invention provide a far better basis for such a system enhanced by a supplementary channel than do the conventional 4-speaker Ambisonic decoders known in the art.

In the preferred implementation of this aspect of the invention, two supplementary channels E, F are used in addition to channels W, X, Y to provide a format termed by the inventor "enhanced B-format". This enhanced format is described fully in the detailed description below.

The present invention in its different aspects is applicable to audio signals that are directionally encoded. Directionality of sounds can be encoded in various ways, using two or more related audio signal channels. In all of these methods, each encoded direction of sound is mixed into the audio signal channels with gains (which may be real or complex, and may be independent of or dependent on frequency) on each signal channel whose values as a function of direction characterise the directional encoding being used.

An overall real or complex gain change applied equally to all audio channels does not change the directional encoding of a sound, but only the gain and phase response of the sound itself. Thus, directional encoding is characterised by the relative gains with which a sound is mixed into the audio signal channels as a function of intended direction.

Examples of directional encoding include the familiar case of conventional amplitude stereophony in which the direction of sounds in two stereo channels is encoded by the relative amplitude gain in two channels normally intended for reproduction via respective left and right loudspeakers. The means of encoding gains as a function of direction often used in studio mixing is the device known as a stereo panpot which allows alteration of the encoded stereo direction by giving adjustment of the relative gains of a sound in the left and right channels. An alternative means of encoding directionally often used is a coincident stereo microphone recording array, where coincident directional microphones pointing in different directions are used, and sounds recorded in different directions around such a microphone array will be encoded into the two channels with different gains determined by the gain response of the two microphones for that incident sound direction.

Conventional two channel stereo is only the simplest of many directional encoding methods known in the prior art. The invention is particularly applicable to methods of surround sound decoding cover a 360° sound stage of directions, such as the methods known as B-format or UHJ described in M. A. Gerzon, "Ambisonics in Multichannel Broadcasting and Video", J. Audio Eng. Soc., Vol. 33, No. 11, pp. 859–871 (1985, November) or to other prior art methods such as BMX directional encoding described later in this description.

These preferred methods of surround sound directional encoding with which the invention may be used encode horizontal directions as linear combinations of three signals, W with constant gain 1 as a function of direction, and directional signals X and Y whose gains as a function of encoded direction follow a figure-of-eight or cosine gain law pointing in two orthogonal directions. For example, in B-format, X may be chosen to have a gain $\sqrt{2}\cos\theta$ and Y a gain $\sqrt{2}\sin\theta$, where $\theta$ is the angle of a direction measured anticlockwise from due front in the horizontal plane. The directionality for B-format can be encoded either by a suitable B-format panpot such as has been described by M. A. Gerzon & G. J. Barton, "Ambisonic Surround Sound Mixing for Multritrack Studios", Conference Paper C1009 of the 2nd Audio Engineering Society International Conference, Anaheim (1984 May 11–14), or by means of a sound field microphone giving a B-format encoded output in response to incident sounds.

Alternatively, any three independent linear combinations of the signals W, X and Y may be used to encode directionality, since B-format signals may be recovered from these by using a suitable inverse 3×3 matrix. Any decoder for reproducing B-format may be converted to one for three such linear combination signals by preceding or combining the B-format decoder with an appropriate 3×3 matrix having the effect of recovering B-format signals.

360° directionality may also be encoded into just two channels as complex linear combinations of W, X and Y. For example, in the prior art in one of the inventors' British Patent 1550628, systems encoding direction are considered that use two independent linear combinations of channels whose gains as a function of directional angle $\theta$ are $$\Sigma=a+b\cos\theta+jc\sin\theta$$

$$\Delta=je+jf\cos\theta+g\sin\theta$$

where the coefficients a, b, c, d, e, f, g are real gain coefficients and where $j=\sqrt{(-1)}$ represents a relative broadband 90° phase difference, which may be implemented by known 90° difference all-pass phase shift networks. As is well known in the prior art, such directionally encoded 2-channel signals may be derived from B-format signals by means of a phase-amplitude matrix incorporating 90° difference networks.

The invention is also applicable to the decoding of a broad range of such 2-channel directionally encoded sound signal channels, including the prior art BMX and UHJ systems, which are of this form. It is also applicable to conventional 2-channel amplitude stereophony encoding, since this directional encoding may be converted to a BMX encoding by inserting a 90° difference between the two channels.

The invention may also be applied to signals in which additional to a 360° azimuthal encoding, directions in three dimensional space are encoded including for example elevated sounds, such as are described in M. A. Gerzon, "Periphony: With-Height Sound Reproduction", J. Audio Eng. Soc., Vol. 21, pp. 2–10 (1973, January/February) and in the cited 1985 Gerzon reference. Additional directionally encoded channels may be added, such as a signal Z with vertical figure-of-eight directional gain characteristic, or the directional enhancement signals E and F described elsewhere in this description.

The invention is additionally applicable to other systems of directional encoding having substantially the same relative gains between signal channels as the systems described above, even if their overall or absolute gains or phases as a function of encoded direction varies.

As already noted, the decoders of the present invention while being generally applicable have particular advantages when used with audiovisual systems. The present invention also encompasses TV, HDTV, film or other audiovisual systems incorporating a decoder in accordance with any one of the preceding aspects in its sound reproduction stages.

Decoders according to the invention may be implemented using any known signal processing technology in ways evident to those skilled in the art, and in particular either using electrical analogue or digital signal processing technology, or a combination of the two.

In the electrical analogue case, matrix networks or circuits may be implemented using resistors or voltage or digitally-controlled active gain elements to implement matrix gain coefficients in combination with active mixing devices such as operational amplifiers to perform addition or subtraction of signals. Frequency-dependent elements such as cross-over network filters may be implemented using any familiar active filter topology. Good approximations to relative 90° difference networks may be implemented by pairs of all-pass networks each comprising cascaded first order all-pass poles of the kind extensively described in the previous literature on, for example, quadraphonic or surround-sound phase-amplitude matrixing or on single sideband modulation using quadrature filters.

In the case where it is preferred to use digital signal processing to implement decoders, analogue-to-digital converters may be used to provide signals in the sampled digital domain, and the decoders may be implemented as signal processing algorithms on digital signal processing chips. In this case, filters may be implemented using digital filtering algorithms familiar to those skilled in the art, and matrices may be implemented by multiplying digital signal words by gain coefficient constants and summing the results. The digital outputs may be converted back to electrical analogue form by using digital-to-analogue converters.

It will be understood by those skilled in the art that matrix, gain and filter means in decoders may be combined, rearranged and split apart in many ways without affecting the overall matrix behaviour, and the invention is not confined to the specific arrangements of matrix means described in explicit examples, but includes, for example, all functionally equivalent means such as would be evident to one skilled in the art.

The outputs of decoders will typically be fed to loudspeakers using intermediary amplifier and signal transmission stages which may incorporate overall gain or equalization adjustments affecting all signal paths equally, and also any gain, time delay or equalization adjustment that may be found necessary or desirable to compensate for the differences in the characteristics of different loudspeakers in the loudspeaker layout or for the differences in reproduction from the loudspeakers caused by the characteristics of the acoustical environment in which the loudspeakers are placed. For example, if the reproduction from one loudspeaker is found to be deficient in a given frequency band relative to the reproduction from the other loudspeakers, a compensating boost equalisation may be applied in that frequency band to feed that loudspeaker without changing the functional performance of the decoder according to the invention.

Especially, but not only in public address applications of the invention, decoders may be fed to loudspeaker layouts using loudspeakers covering only a portion of the audio frequency range, and different loudspeaker layouts may be used for different portions of the audio frequency range. In this case, the directionally encoded audio signals may be fed to different decoder algorithms for loudspeaker layouts used in different frequency ranges by means of cross-over networks.

As with prior art Ambisonic decoders, it is a characteristic of decoders according to the invention that for any given directional encoding specification, the matrix algorithms used to derive signals suitable for feeding to loudspeakers depends on the loudspeaker layout used with the decoder, as will be described in more detail below and in the appendices.

It is therefore desirable that the decoder should incorporate or be used with means of adjusting the decoder matrix coefficients in accordance with the loudspeaker layout it is intended to use with the decoder, so that correct directional decoded results may be obtained. For example, as disclosed in one of the inventors British Patent 1494751 filed 1974, Mar. 26, prior art Ambisonic decoders for rectangular loudspeaker layouts incorporated gains in two velocity signal paths in decoders as a means of adjusting for different shapes of rectangle, and in commercially available decoders this is implemented by means of a potentiometer adjusting the gain of two velocity signal paths whose settings are calibrated either with pictures of the layout shape or with the ratio of the two sides of the rectangle. In a similar way, one of the inventors British Patent 2073556 filed 1980 discloses the provision of gain adjustments in velocity signal paths in decoders for certain loudspeaker layouts where loudspeakers are disposed in diametrically opposite pairs.

In general, loudspeaker layout control means may constitute a number of adjustable matrix coefficients in the decoder linked to a means of adjusting these in accordance with an intended or actual reproduction loudspeaker layout. The adjustment means may constitute potentiometers or digitally or voltage controlled gain elements in analogue implementations or a means of computing or looking up in a table the matrix coefficients in a digital signal processor, and a means incorporating these coefficients in a signal processing matrix algorithm.

The method of adjustment may be in response to a control menu specifying the shape of the loudspeaker layout, or one or more controls adjusting analogue parameters defining the loudspeaker layout shape, or a combination of these, or any other well known means of adjusting parameters in signal processing systems. The loudspeaker layout may be determined by geometrical measurements, for example with a measurement tape, or by any known automatic or semi-automated measurement technique such as those used to determine distance in autofocus cameras. In the automated case, the results of the measurements may be used to compute appropriate matrix coefficients, for example by interpolation between the precomputed values of matrix coefficients on a discrete range of loudspeaker layouts computed by the methods indicated in the appendices.

In the prior Ambisonic art, the layout control adjustment of matrix coefficients has the effect of altering only signals represented reproduced velocity, but not signals representing the reproduced pressure. In contrast, for many loudspeaker layouts to which the present invention is applicable, including those with more loudspeakers disposed across a frontal stage than across a diametrically opposed rear stage, the layout control adjustment of matrix coefficients has the effect of altering not only signals representing reproduced velocity, but also signals representing the reproduced pressure as well, as may be seen by computing the pressure signal (which is the sum of the loudspeaker output signals) for various loudspeaker layouts disclosed in the appendices.

The invention may be used in conjunction with the methods disclosed in British Patent 1552478 to compensate for different loudspeaker distances from a preferred listening position in the listening area. The decoding matrices of the present invention may be combined with time delays and gain adjustments for the output loudspeaker feed signals that compensate for the altered time delay and gains of sounds arriving at the preferred listening position caused by unequal loudspeaker distances from the preferred listening position.

BRIEF DESCRIPTION OF THE DRAWINGS

The present invention will now be described in further detail with reference to the accompanying drawings, in which.

DETAILED DESCRIPTION OF EMBODIMENTS

Figure 1:
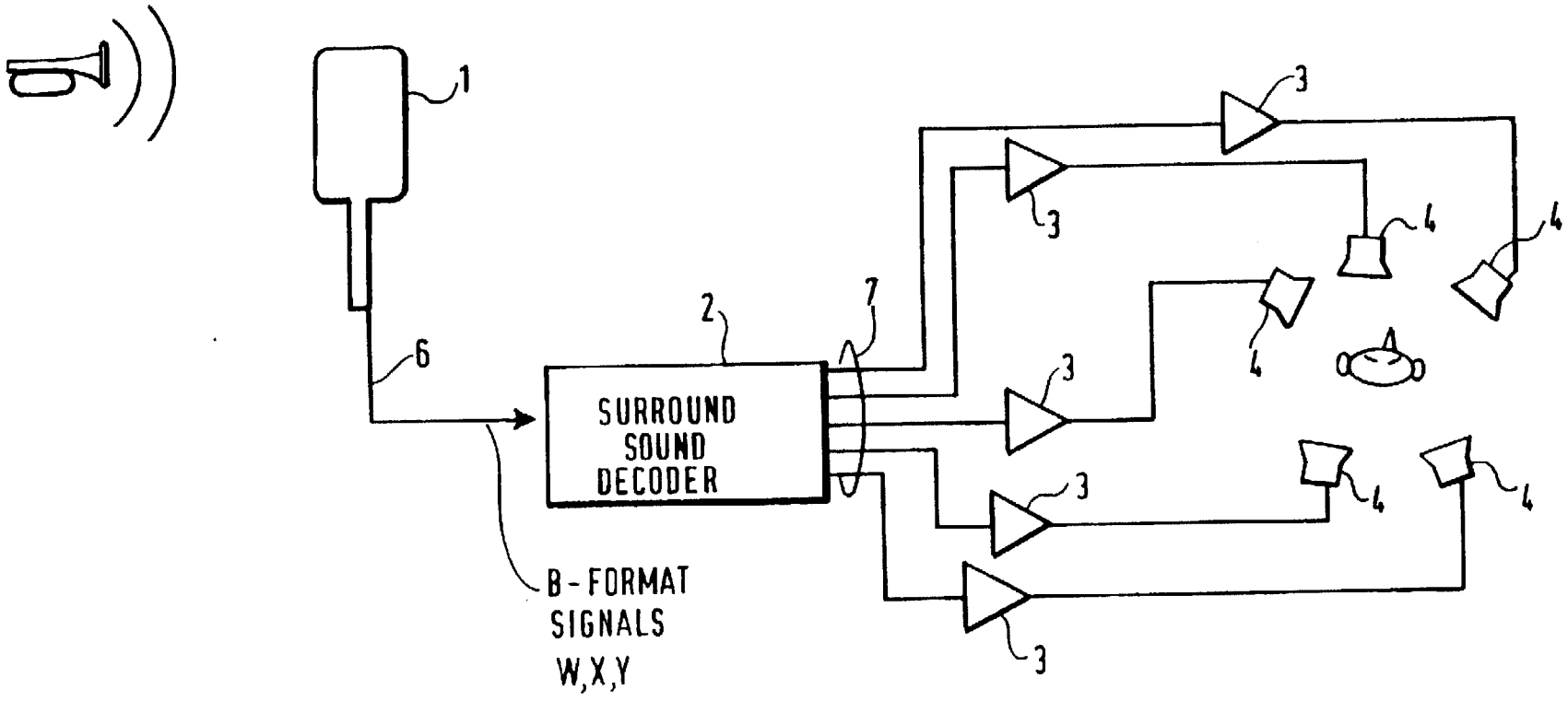
FIG. 1 is a diagram illustrating an encoding/reproduction system.
Figure 2:
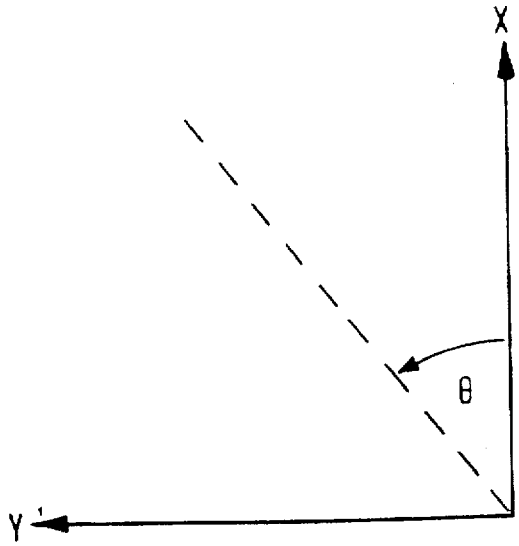
FIG. 2 is a diagram illustrating the coordinate conventions.

FIG. 1 is a block diagram illustrating a typical ambisonic encoding/reproduction chain. An incident sound field is encoded by a SoundField microphone 1 into B-Format signals. The resulting WXY signals are applied to an ambisonic decoder. The ambisonic decoder 2 applies to the WXY signals a decoding matrix which derives output signals from weighted linear combinations of the W X and Y signals. These output signals are then amplified by amplifiers 3 and supplied to speakers 4 arranged in a predetermined format around a listener 5.

The sound field microphone 1 is a one-microphone system such as that currently commercially available from AMS as the Mark IV SoundField microphone.

Figure 3:
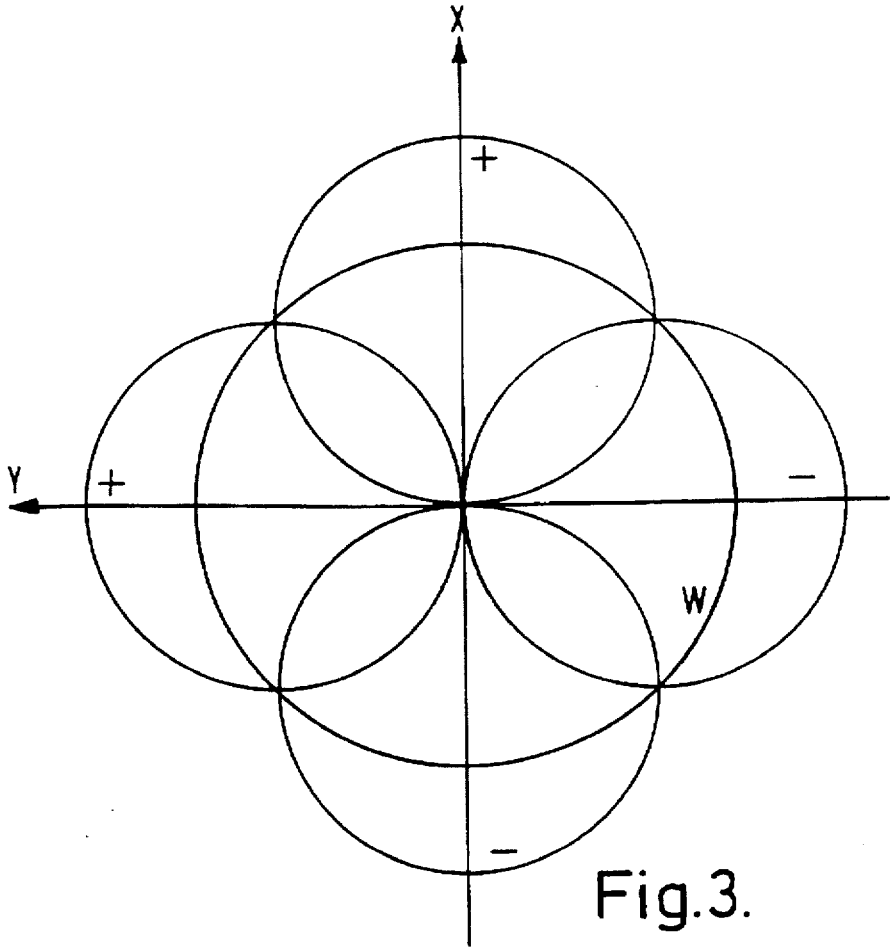
FIG. 3 is a polar response diagram for horizontal B format.
Figure 4:
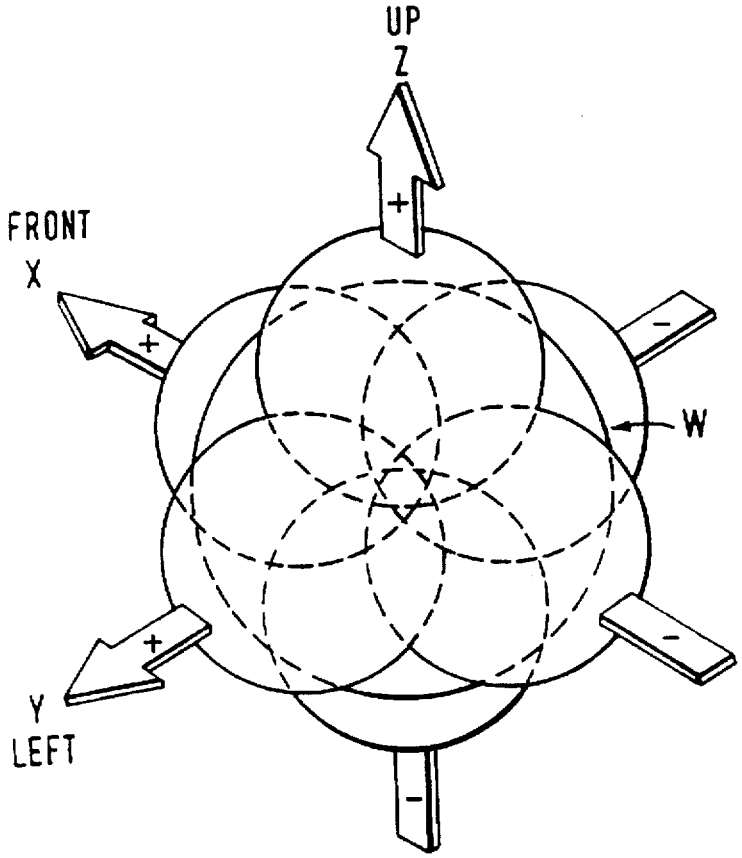
FIG. 4 is a polar response diagram for full sphere B format.
Figure 5:
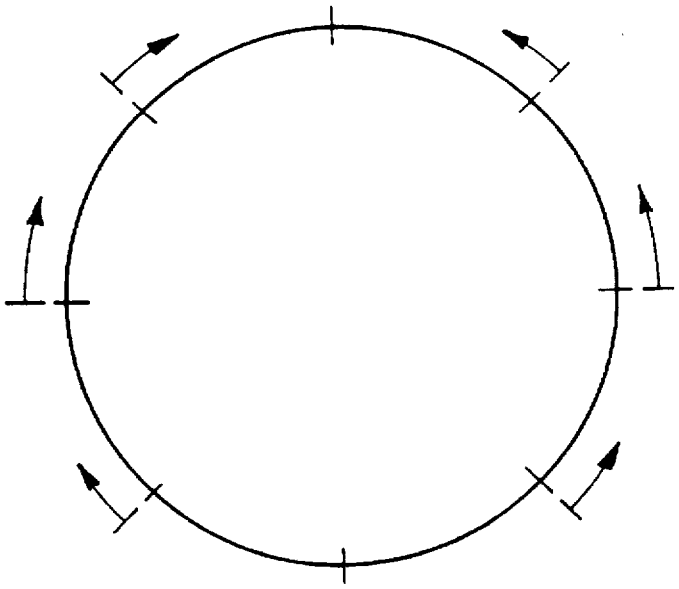
FIG. 5 is a diagram illustrating a forward dominance transformation.

FIG. 3 shows the horizontal polar diagrams of the B-format signals. As noted above, B-format can be extended to include four full-sphere directional signals as shown in FIG. 4.

As an alternative to direct encoding of sound using a SoundField microphone, it is also possible to produce horizontal B-format signals using a B-format panpot which feeds an input signal directly to the W output with gain 1, and uses a 360° sine/cosine panpot with an additional gain $2^{1/2}$ to feed the respective Y and X outputs. This is described in the paper by the present inventors "Ambisonic Surround-Sound Mixing for Multi Track Studios" Conference Paper C1009, 2nd AES International Conference "The Art and Technology of Recording", Anaheim, Calif. (1984 May 11–14).

The ambisonic decoding equation used to derive the loudspeaker feed signal from the WXY signals is determined for a given loudspeaker layout in accordance with certain psychoacoustic criteria formally represented by the so-called Ambisonic equations. As described in further detail below, these define different constraints appropriate to different frequency bands for the reproduced sound in terms of the energy vector and velocity vector together with the scalar pressure signal P.

The localisation given by signals emerging with different gains $g_i$ from different loudspeakers around a listener can be related to physical quantities measured at the listener location. In particular, it can be shown that localisation given at low frequencies by interaural phase localisation theories below about 700 Hz is determined by the vector given by dividing the overall acoustical vector velocity gain of a reproduced sound at the listener by the acoustical pressure gain at the listener. In the case of complex signals, the real part of this vector is used. The resulting vector, for natural sound sources, has length one and points at the direction of the sound source. For sounds reproduced from several loudspeakers, the length $r_v$ of this vector should ideally be as close to 1 as possible, especially for sounds intended to be near azimuths ±90°, and the azimuth direction $\theta_v$ of this vector is an indication of the apparent sound direction.

Between about 700 Hz and about 4 kHz (and these figures are merely rather fuzzy indications), and also for non-central listeners hearing mutually phase-incoherent sound arrivals from different speakers below 700 Hz, localisation is determined by that vector which is the ratio of the vector sound-intensity gain to the acoustical energy gain of a reproduced sound. Again, for natural sound sources, this vector would have length one and point to the sound source. For reproduced sounds, the length $r_E$ of this vector should be as close to one as possible (it can never exceed 1) for maximum stability of the image under listener movement, and its direction azimuth $\theta_E$ is an indication of the apparent direction of the image.

These vector quantities can be computed from a knowledge of the gains $g_i$ with which a sound source is fed to each of the loudspeakers, as follows. Suppose one has n loudspeakers all at equal distances from the listening position; let the i'th loudspeaker be at azimuth $\theta_i$ and reproduce a sound with gain $g_i$. (While the theory can be developed for complex gains $g_i$, we here assume that $g_i$ is real for simplicity). The acoustical pressure gain is then simply the sum $$P = \sum_{i=1}^{n} g_i \tag{5}$$

of the individual speaker gains. The velocity gain is the vector sum of the n vectors with respective lengths $g_i$ pointing towards azimuth $\theta_i$ (i.e. towards the associated loudspeaker), which has respective x- and y-components (6x)

and $$V_y = \sum_{i=1}^{n} g_i \sin\theta_i \tag{6x}$$

$$V_x = \sum_{i=1}^{n} g_i \cos\theta_i \tag{6y}$$

By dividing this velocity gain vector by the pressure gain P, one obtains a velocity localisation vector of length $r_v \geqq 0$ pointing in direction azimuth $\theta_v$, where $$r_v \cos\theta_v = V_X/P \tag{7x}$$

$$r_v \sin\theta_v = V_Y/P. \tag{7y}$$

$\theta_v$ is termed the velocity vector localisation azimuth, or Makita localisation azimuth, and is the apparent direction of a sound at low frequencies if one turns one's head to face the apparent direction. $r_v$ is termed the velocity vector magnitude and ideally equals one for single natural sound sources. The two quantities $\theta_v$ and $r_v$ are indicative of apparent localisation direction and quality according to low-frequency interaural phase localisation theories, with deviations of $r_v$ from its ideal value of one indicative of image instability under head rotations, and poor imaging quality particularly to the two sides of a listener.

A similar procedure is used according to energy theories of localisation, but with the square $|g_i|^2$ of the absolute value of the gain from each speaker replacing the gain $g_i$. The overall reproduced energy gain is $$E = \sum_{i=1}^{n} |g_i|^2 \tag{8}$$

and the sound-intensity gain is the vector sum of those vectors pointing to the i'th speaker with length $|g_i|^2$, which has x- and y- components $$E_x = \sum_{i=1}^{n} |g_i|^2 \cos\theta_i \tag{9x}$$

and $$E_y = \sum_{i=1}^{n} |g_i|^2 \sin\theta_i \tag{9y}$$

By dividing this sound-intensity gain vector by the overall energy gain E, one obtains an energy localisation vector of length $r_E \geqq 0$ pointing towards the direction azimuth $\theta_E$, where $$r_E \cos\theta_E = E_x/E \tag{10x}$$

$$r_E \sin\theta_E = E_y/E. \tag{10y}$$

$\theta_E$ is termed the energy vector localisation azimuth, and is broadly indicative of the apparent localisation direction either between 700 Hz and around 4 kHz, or at lower frequencies in the case that the sounds arrive in a mutually incoherent fashion at the listener from the n loudspeakers.

$r_E$ is termed the energy vector magnitude of the localisation, and is indicative of the stability of localisation of images either in the frequency range 700 Hz to 4 kHz or at lower frequencies under conditions of phase-incoherence of sound arrivals. As before with $r_v$, the ideal value for a single sound source is equal to 1. Because $r_E$ is the average (with positive coefficients $|g_i|^2/(\Sigma|g_i|^2)$) of n vectors of length 1, it is only equal to 1 if all sound comes from a single speaker. Generally $r_E$ is less than 1, and the quantity $1-r_E$ is roughly proportional to the degree of image movement as a listener moves his/her head. Ideally, for on-screen sounds with HDTV, one would like $1-r_E<0.02$, but one finds that typically for central stereo images with 2-speaker stereo that $1-r_E=0.134$, and for surround-sound systems that $1-r_E$ lies between 0.25 and 0.5.

For frontal stage stereo systems subtending relatively narrow angles (say with stage widths of less than 60°), it is found that the value of $r_v$ is not critical providing that it lies between say 0.8 and 1.2, but that the value of $r_E$ is an important predictor of image stability. For surround sound systems aiming to produce images at each side of a listener, however, making $r_v$ equal one accurately at low frequencies becomes much more important, since the low-frequency localisation cue is one of the few cues that can be made correct for such side-stage images, and the accuracy of such localisation depends critically on the accuracy of $r_v$.

It has thus been found that the localisation criteria for front-stage stereo and for surround sound are somewhat different in their practical trade offs.

For all methods of reproduction, it has been found that it is desirable that the two localisation azimuths $\theta_v$ and $\theta_E$ should be broadly equal, so that any decoding method should ideally be designed to produce speaker feed gains $g_i$ for all localisation azimuths such that $$\theta_v = \theta_E \tag{11}$$

at least for frequencies up to around 3½ or 4 kHz. This ensures that different auditory localisation mechanisms give broadly the same apparent reproduced azimuth, especially in those frequency ranges in which more than one mechanism is operative. Equation (11), which is an equation relating the quantities $g_i$ via equations (5) to (10), can be written in the form $$E_x V_Y = E_y V_x \tag{12}$$

and is seen in general to be cubic in the gains $g_i$. If equations (11) or (12) are satisfied, there is a tendency for illusory phantom images to sound more sharp and precise than if $\theta_V$ and $\theta_E$ differ substantially.

However, sharpness is not the same as image stability, and additional requirements on $r_v$ and $r_E$ are necessary for optimum imaging stability. For surround sound systems, it is highly desirable, under domestic scale listening conditions, that $$r_v 1 \tag{13}$$

for all reproduced azimuths at low frequencies, typically under 400 Hz, at a central listening location. However, above 400 Hz, it is instead desirable that the value of $r_E$ be maximised. With some exceptions, it is generally not possible to design a reproduction system to be such as simultaneously to maximise $r_E$ in all reproduced directions, so that in practice, some design trade off is made between the values of $r_E$ in different reproduced directions. In general, for surround-sound systems, $r_E$ above 400 Hz is designed to be larger across a frontal stage than in side and rear directions, but not to the extent that side and rear sounds become intolerably unstable.

The optimisation of $r_E$ above about 400 Hz is partly a matter of design skill and experience obtained over a period of years, but some of this skill can be codified as informal rules of thumb. It is generally highly undesirable that $1-r_E$ should vary markedly in value for sounds at only slightly different azimuths, since such variations will cause some sounds to be much more unstable than other near by ones. In general, it is desirable that $r_E$ be maximised at the due front azimuth or across a frontal stage, and it is desirable that the values of $r_E$ in other directions vary smoothly.

A decoder or reproduction system for 360° surround sound is defined to be Ambisonic if, for a central listening position, it is designed such that (i) the equations (11) or (12) are satisfied at least up to around 4 kHz, such that the reproduced azimuth $\theta_v=\theta_E$ is substantially unchanged with frequency, (ii) at low frequencies, say below around 400 Hz, equation (13) is substantially satisfied for all reproduced azimuths, and (iii) at mid/high frequencies, say between around 700 Hz and 4 kHz, the energy vector magnitude $r_E$ is substantially maximised across as large a part of the 360° sound stage as possible.

In large reproduction environments, such as auditoria, it is unlikely that a listener will be within several wavelengths of a central listening seat; under these conditions, the requirement of equation (13) is desirably not satisfied, although it is still found that satisfying equations (11) or (12) gives useful improvements in phantom image quality.

The Ambisonic decoding equations (11) to (13), plus the requirement for maximising $r_E$ above 400 Hz, are in general a highly nonlinear system of equations. Prior-art solutions to these equations involved the use of loudspeaker layouts with a rather high degree of symmetry, e.g. regular polygons, rectangles, or involving diametrically opposite pairs of loudspeakers but the new solutions in accordance with the present invention apply to much less symmetrical speaker layouts.

Previously, in finding solutions for the Ambisonic decoder solutions have been selected such that the reproduced acoustical pressure gain P, as defined above had a directional gain pattern as a function of encoded azimuth θ which was the same at low and high frequencies, apart from a simple adjustment of overall gain with frequency. In the presently described decoders, by contrast, the values of the decoding matrix is such that while the output from the speakers satisfies the Ambisonic decoding equations, different directional gain patterns for the pressure signal P result at different frequencies. A further characteristic of the decoding matrixes is that they result in the magnitude of the velocity vector $r_v$ varying systematically with encoding azimuth θ rather than being substantially constant with azimuth as in previous Ambisonic decoders. In particular, $r_v$ is made substantially to track $r_E$ in a mid-high frequency range of e.g. 700 Hz to 4 kHz while in a low frequency range up to e.g 400 Hz $r_v$ is as far as possible equal to one.

It is found that the use of a decoding matrix having these characteristics gives markedly improved image stability. Moreover, it is possible in addition to find solutions for a decoder to feed a loudspeaker layout incorporating additional central loudspeakers such as the five or six - speaker layouts illustrated in the Figures. The derivation of solutions for such layouts will be described in further detail below.

One characteristic of the Ambisonic decoding matrices is that they increase the gain of those signals for which $r_E$ is lowest, which will typically be the rear-stage signals. Accordingly, to counter this effect, the decoder is arranged to apply a forward dominance transformation to the B-format signal W,X,Y. This is a Lorentz transformation which produces transformed signal components $$W^1=\tfrac{1}{2}(\lambda+\lambda^{-1})W+8^{-1/2}(\lambda-\lambda-1)X$$

$$X^1=\tfrac{1}{2}(\lambda+\lambda^{-1})X+2^{-1/2}(\lambda-\lambda^{-1})W$$

$$Y^1=Y \qquad (3)$$

W' X' Y' satisfying the above equation where λ is a real parameter having any desired positive value.

It follows from the above relationship that a due-front B-format sound with W,X,Y gains of 1, $2^{1/2}$ and 0 respectively is transformed into one with a gain λ times larger whereas a due-rear sound with original gains 1,$-2^{1/2}$ and 0 respectively is transformed into a rear sound with gain multiplied by $\lambda^{-1}$. Thus this forward dominance transformation increases front sound gain by factor λ whereas it alters rear sound gains by an inverse factor 1/λ and the relative gain of front to back sounds is altered by a factor $\lambda^2$ which allows the relative gain of reproduction of rear sounds to be modified to reduce (or increase) their relative contributions.

This use of forward dominance control is important in various applications of B-format to HDTV. In a production application, it can be used to de-emphasise sounds from the rear of a sound field microphone while still giving a true B-format output. However, it can also be used in different reproduction modes relying on B-format input signals to de-emphasise rear sounds. In particular, in the new B-format Ambisonic surround-sound decoders of the present invention which may otherwise give excessive gain for rear sounds can be compensated for by a judicious application of a compensating forward dominance.

Besides altering the front-to-rear level balance, forward dominance also alters the directional distribution and azimuths of sounds (other than those at due front and directions). FIG. 4 shows the effect of forward dominance with $\lambda=2^{1/2}$. Without going into the detailed analysis, it can be shown that an original azimuth θ is transformed into a new azimuth θ' given by the equation $$\cos\theta' = \frac{\mu+\cos\theta}{1+\mu\cos\theta} \qquad (4a)$$

where $$\mu=(\lambda^2-1)/(\lambda^2+1). \qquad (4b)$$

If λ>1, then all directions are moved towards the front, and if λ<1, all directions are moved towards the back by the forward dominance transformation of equation (3). The width of a narrow stage around due front is multiplied by a factor 1λ, and of a narrow stage around the back is multiplied by a factor λ, as shown in FIG. 4, by this transformation, so that forward dominance is a kind of B-format "width control" that narrows the front stage as it widens the rear stage, or vice-versa. The relative front-to-back amplitude gain $\lambda^2$, expressed in decibels, is termed the "dominance gain", so that $\lambda=2^{1/2}$ is said to have a dominance gain of +6.021 dB. This dominance gain causes images at the sides (azimuths ±90°) to move forward by an angle of $\sin^{-1}\tfrac{1}{2}=19.47°$ in the B-format sound stage, via equation (4).

Although for simplicity the forward dominance transformation may be considered as a separate operation carried out on the input W,X,Y signals, before the transformed signals are applied to the decoding matrix, in practice both the transformation and the decoder may be carried out by a single matrix.

Figure 6:
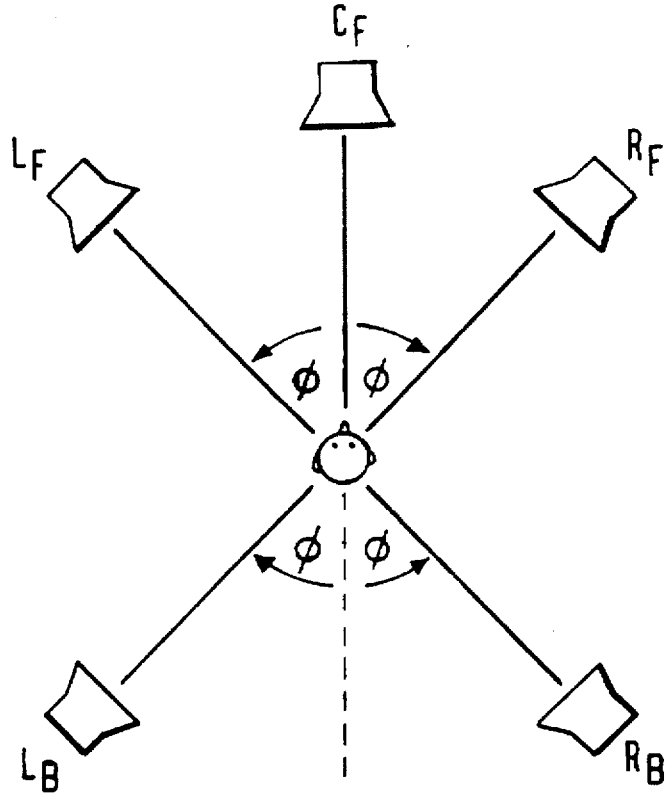
FIGS. 6 and 7 are diagrams showing alternative 5-speaker layouts.
Figure 7:
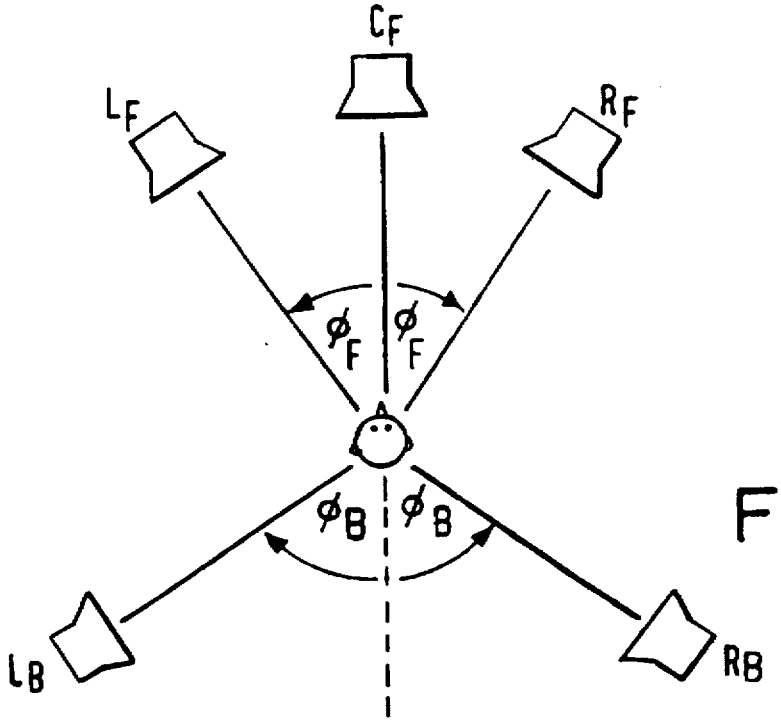

Considering now in detail the derivation of the coefficients for the decoding matrix in the enhanced Armbisonic decoders, FIGS. 6–9 show typical speaker layouts which will be considered for 360° surround-sound reproduction. FIG. 6 shows a rectangular speaker layout using left-back $L_B$, left-front $L_F$, right-front $R_F$ and right-back $R_B$ speakers at respective azimuths 180°−ϕ, ϕ, −ϕ and −180°+ϕ, supplemented by an extra centre-front $C_F$ loudspeaker. FIG. 7 shows a similar 5-speaker layout, except that now the azimuth angles $\pm\phi_F$ of the front pair differs from that $180°\pm\phi_B$ of the rear pair, so that the $L_B$, $L_F$, $R_F$ and $R_B$ speakers form a trapezium layout.

Figure 8:
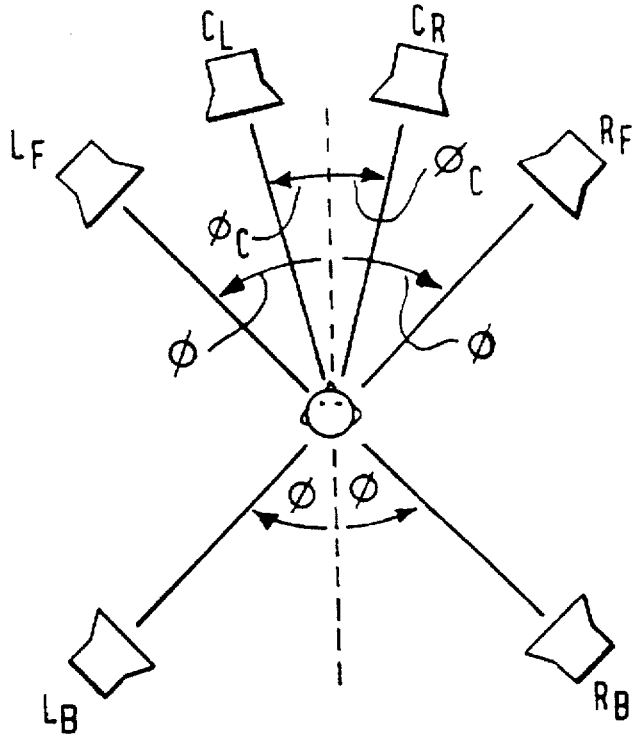
FIGS. 8 and 9 are diagrams showing alternative 6-speaker layouts.
Figure 9:
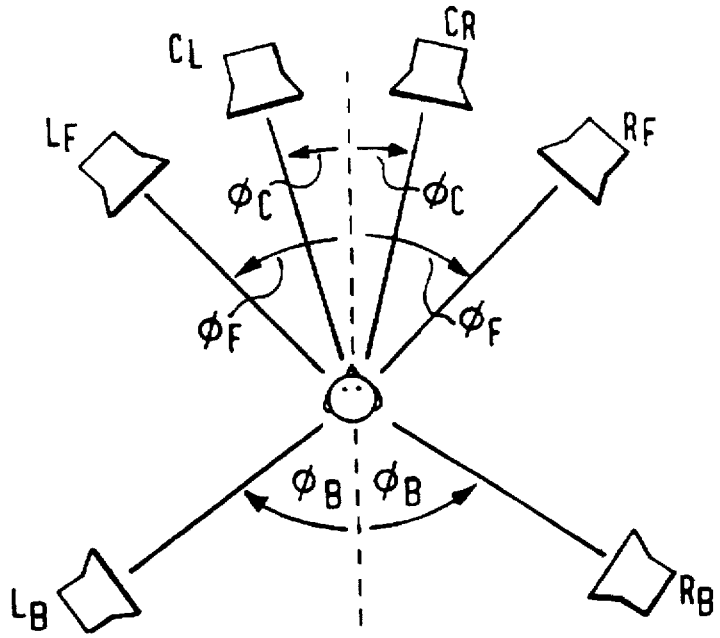

FIGS. 8 and 9 show similar rectangle and trapezium speaker layouts respectively, but this time supplemented by a frontal pair of speakers $C_L$ and $C_R$ at respective azimuths $+\phi_C$ and $-\phi_C$.

There is already a long-known Ambisonic decoder for B-format for the 4-speaker rectangular layout shown in FIGS. 6 or 8, for which $\theta_V=\theta_E=\theta$ for all encoded azimuths θ. However, this decoder has identical $r_E$ for due front and due back sounds above about 400 Hz, and for square loudspeaker layouts has $r_E$ equal to 0.7071 in all directions, which is not adequate for frontal-stage sounds for use with TV. However, it is possible to show that for the rectangular layouts of FIGS. 6 and 8, there are other Ambisonic decoders that feed the additional frontal speakers so as to increase $r_E$ for front-stage sounds, at the expense of slightly decreasing $r_E$ at the sides and rear.

Although the speaker layouts of FIGS. 6 to 9 lack a high degree of symmetry, they are still left/right symmetrical, i.e. symmetrical under reflection about the forward direction. We assume here that we are considering a left/right symmetric speaker layout in which all speakers lie at the same distance from a listener. We seek to find for the various speaker layouts of this kind those real left/right symmetrical linear combinations of the B-format signals W, X and Y such that the equations $$\theta_v=\theta_E=\theta \tag{25}$$

are satisfied for all encoding azimuths θ in the 360° sound stage. Having found all such solutions, the next step is to find among those solutions ones with $r_v=1$ for low frequencies and those with maximised $r_E$ at higher frequencies, and to use a frequency-dependent matrix to implement these two matrices in a frequency-dependent manner as an Ambisonic decoder. The decoder architecture we now describe, and the associated methods of solution described in Appendix A works for quite general left/right symmetric speaker layouts, although the numerical details of the solution process can be extremely messy in particular cases, requiring the use of powerful computing facilities.

In order to take advantage of left/right symmetry, it is convenient to express the speaker feed signals illustrated in FIGS. 6 to 9 in sum and difference form as follows:

$$\begin{aligned} L_F&=M_F+S_F\\ R_F&=M_F-S_F\\ L_B&=M_B+S_B\\ R_B&=M_B-S_B\\ C_L&=C_F+S_C\\ C_R&=C_F-S_C \end{aligned} \tag{26}$$

Because of the left/right symmetry requirement, at any frequency one can write the signals $C_F$, $S_C$, $M_F$, $S_F$, $M_B$ and $S_B$ in terms of B-format in the following form:

$$\begin{aligned} S_C&=k_C Y\\ S_F&=k_F Y\\ S_B&=k_B Y\\ C_F&=a_C W+b_C X\\ M_F&=a_F W+b_F X\\ M_B&=a_B W-b_B X, \end{aligned} \tag{27}$$

where $k_C$, $k_F$, $k_B$, $a_C$, $a_F$, $a_B$, $b_C$, $b_F$, $b_B$ are real coefficients (which typically will all be positive, excepting $k_C$ which may be zero).

Figure 10:
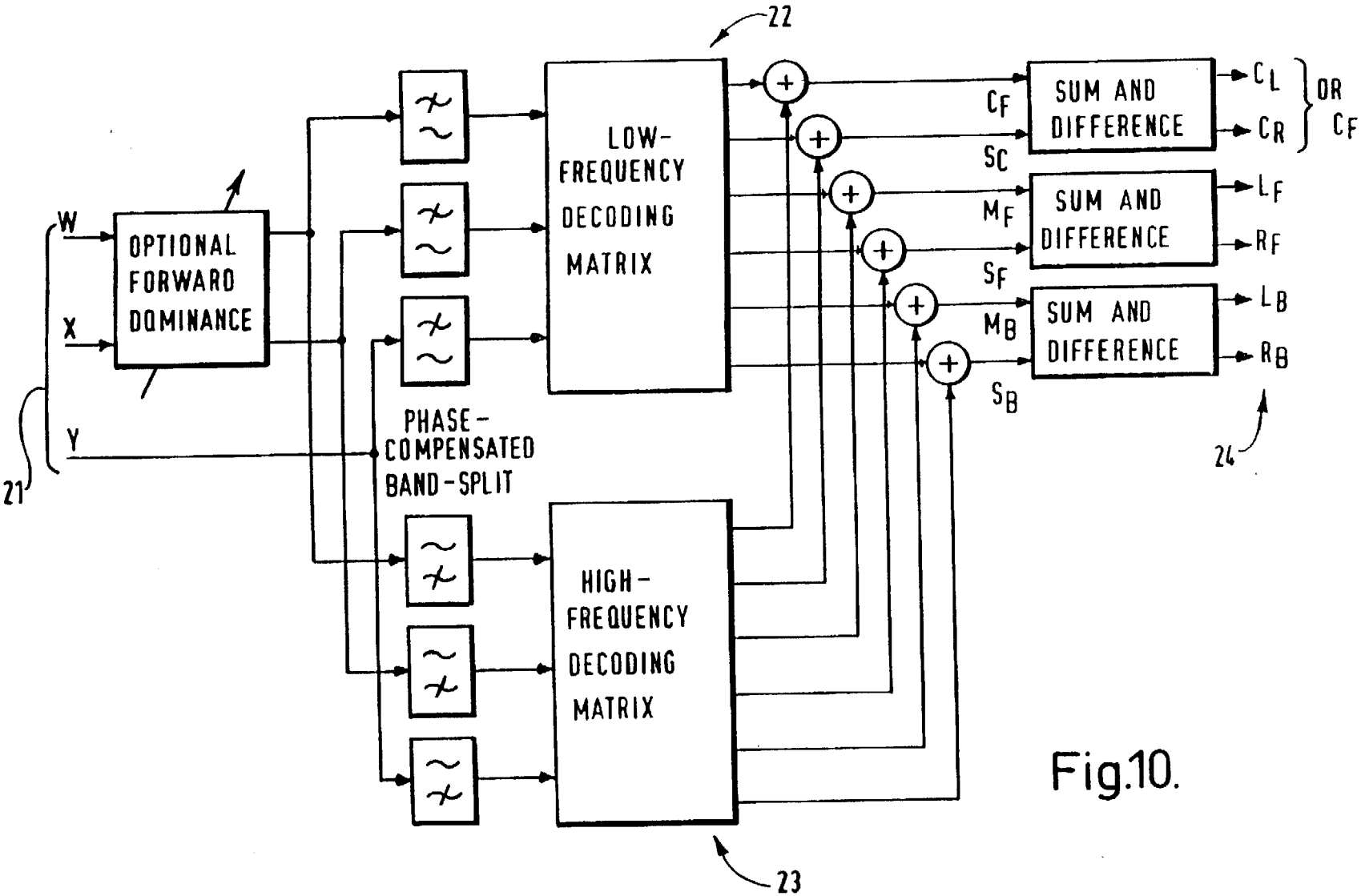
FIG. 10 is a diagram showing the architecture of a B-format Ambisonic decoder for the layouts of FIGS. 6 to 9.

FIG. 10 shows the general architecture of an Ambisonic decoder for the speaker layouts of FIGS. 6 to 9, based on equation (27). At the B-format input, there is provided optionally a forward-dominance adjustment according to equation (3) so that the relative front/back gain balance and directional distribution of sounds can be adjusted. Each of the three resulting B-format signals is then passed into a phase compensated band-splitting filter arrangement, such that the phase responses of the two output signals are substantially identical. Typically for domestic listening applications, the cross-over frequency of the phase-compensated band-splitting filters will be around 400 Hz, and the sum of low and high frequency outputs will be equal to the original signal passed through an all-pass network with the same phase response. For example, the low-pass filters in FIG. 10 might be the result of cascading two RC or digital first order low-pass filters with low frequency gain 1, and the high-pass filters might be the result of cascading two first order high pass filters with the same time constants, with high frequency gain of −1; these filters sum to a first order all-pass with the same time constant, and have identical phase responses.

The low-frequency B-format signals resulting are fed to a low-frequency decoding matrix to implement equation (27) for coefficients appropriate below 400 Hz (typically ensuring that $r_v=1$), and the high-frequency B-format signals are fed to a second high-frequency decoding matrix to implement equations (27) for a second set of coefficients appropriate to the higher frequencies at which $r_v$ is to be maximised. The resulting low and high frequency signals $C_F$, $S_C$ (where it exists), $M_F$, $S_F$, $M_B$ and $S_B$ are then summed together and fed to output sum and difference matrices to provide speaker feed signals suitable for the speaker layouts of FIGS. 6 to 9. In the case of 5-speaker layouts such as those of FIGS. 6 or 7, or in the case of 6-speaker layouts in the case that $C_L=C_F=C_F$, the $S_C$ signals path and the top sum-and-difference matrix in FIG. 10 may be omitted.

The use of phase compensation (i.e. phase matching) of the band-splitting filters in FIG. 10 is found to be highly desirable for surround sound decoders, since any "phasiness" errors due to relative phase shifts between signal components are magnified by the large 360° angular distribution of sounds, although in some cases, the use of filters that are not phase matched may prove acceptable. It is also clear that the architecture of FIG. 10 can be extended to 3 or more frequency bands by using a three-band phase-splitting arrangement with three decoding matrices, so as to optimise localisation quality separately in three or more bands. Typically a three band decoder might have crossover frequencies at 400 Hz and at or around 5 to 7 kHz so as to optimise localisation in the pinna-colouration frequency region above about 5 kHz.

It is also evident that, rather than bandsplitting into, say, low and high frequency bands as in FIG. 10, other band-splitting arrangements can be used, e.g. an all-pass path feeding high frequency decoding matrix coefficients and a phase-matched low-pass path feeding a decoding matrix whose coefficients are the difference between the low and high frequency coefficients. Similarly, part or all of the output sum and differencing process might be implemented in the decoding matrices before the band-combining summing process. Such variations on the architecture shown in FIG. 10 are relatively trivial practical modifications that would be evident to a skilled designer.

In particular, the forward dominance adjustment might be implemented directly as modified coefficients $a_C$, $b_C$, $a_F$, $b_F$, $a_B$, $b_B$ rather than or in addition to an input forward dominance matrix.

Besides possibly implementing forward dominance and overall gain adjustments, the decoding matrices in FIG. 10 will, in general, have matrix coefficients that vary with the speaker layout in use, so that a typical Ambisonic decoder implemented as in FIG. 10 will have a means of causing the matrix coefficients to be altered in response to the measured or assumed speaker layout shape and angles shown in FIGS. 6 to 9. This may be done by a microprocessor software adjustment of coefficients, or by manual gain adjustment means.

Appendix A below describes a general method for finding decoder solutions having the properties discussed above and Table 1 lists the values of the matrix coefficients for a given layout, and also describes the performance of the decoder in the different high and low frequency domains. Appendix B goes on to describe specific analytic solutions for particular layouts and Appendix C and Table 2 describe the low and high frequency solutions for nine different 5-speaker layouts.

As noted in the introduction above, as well as providing an inherently improved front-stage image stability, the Ambisonic decoders of the present invention also provide a suitable basis for an enhanced decoder including additional channels providing improved stability of and separation between the front and rear stages. At the very simplest, in such an enhanced system one can add one additional channel signal denoted by E which incorporates a feed for a front loudspeaker. Such an isolated centre front signal has been found to be important in film and HDTV applications, in that typically dialogue and other sounds from the centre of the screen are more important than any other directions, and experiments in using Ambisonics plus a front-centre speaker feed have confirmed that such a method also works well in cinema applications. However, having only a single sound position that is highly stable proves rather inflexible and unsubtle for many applications. Nevertheless, such an added E channel in combination with B-format signals can yield useful benefits. A second added channel F can be used largely to cancel front-to-rear stage cross talk (which is largely due to the Y -signal) and to widen the frontal stage. In combination with E and the three B-format signals, the F signal gives a frontal stage reproduction closely approximating 3-channel frontal stereo. Any sounds assigned to such a high-stability frontal stage should also be encoded conventionally into the three B-format signals so that users discarding the E and F signals will still get B-format reproduction incorporating those sounds.

In view of these considerations, the present example provides a decoder for an enhanced B-format comprising up to 5 signals W,X,Y, E and F for studio production applications in horizontal surround-sound with enhanced frontal image stability. This encodes signals from azimuth θ into the five channels with respective gains W with gain 1

X with gain $2^{1/2}\cos\theta$

Y with gain $2^{1/2}\sin\theta$

E with gain $k_e(1-3.25(1-\cos\theta))$ for $|\theta|\leqq\theta_S$ and gain 0 for $|\theta|>\theta_S$ F with gain $2^{1/2}k_f\sin\theta$ for $|\theta|\leqq\theta_S$, gain $-2^{1/2}k_b\sin\theta$ for $|180°-\theta|\leqq\theta_B$ and gain 0 for other θ where $\theta_S$ is a frontal stage half width, typically between 60° and 70°, $\theta_B$ is the rear half stage width, typically around 70° and the gains $k_e$ and $k_f$ may be chosen between zero (for pure B-format) and a value in the neighbourhood of or equal to one (for reproduction effect purely in the front and rear stages). The co-efficient 3.25 may be subjected to slight changes in value somewhere between 3 and 3.5. Enhanced B-format thus allows, by variations of the gains $k_e$, $k_f$, and $k_b$ (which should preferably be roughly equal), the assignation of frontal stage sounds anywhere between pure B-format and positioning in the front and rear stages. As a production format, it allows reproduction in a large variety of different modes.

Figure 11:
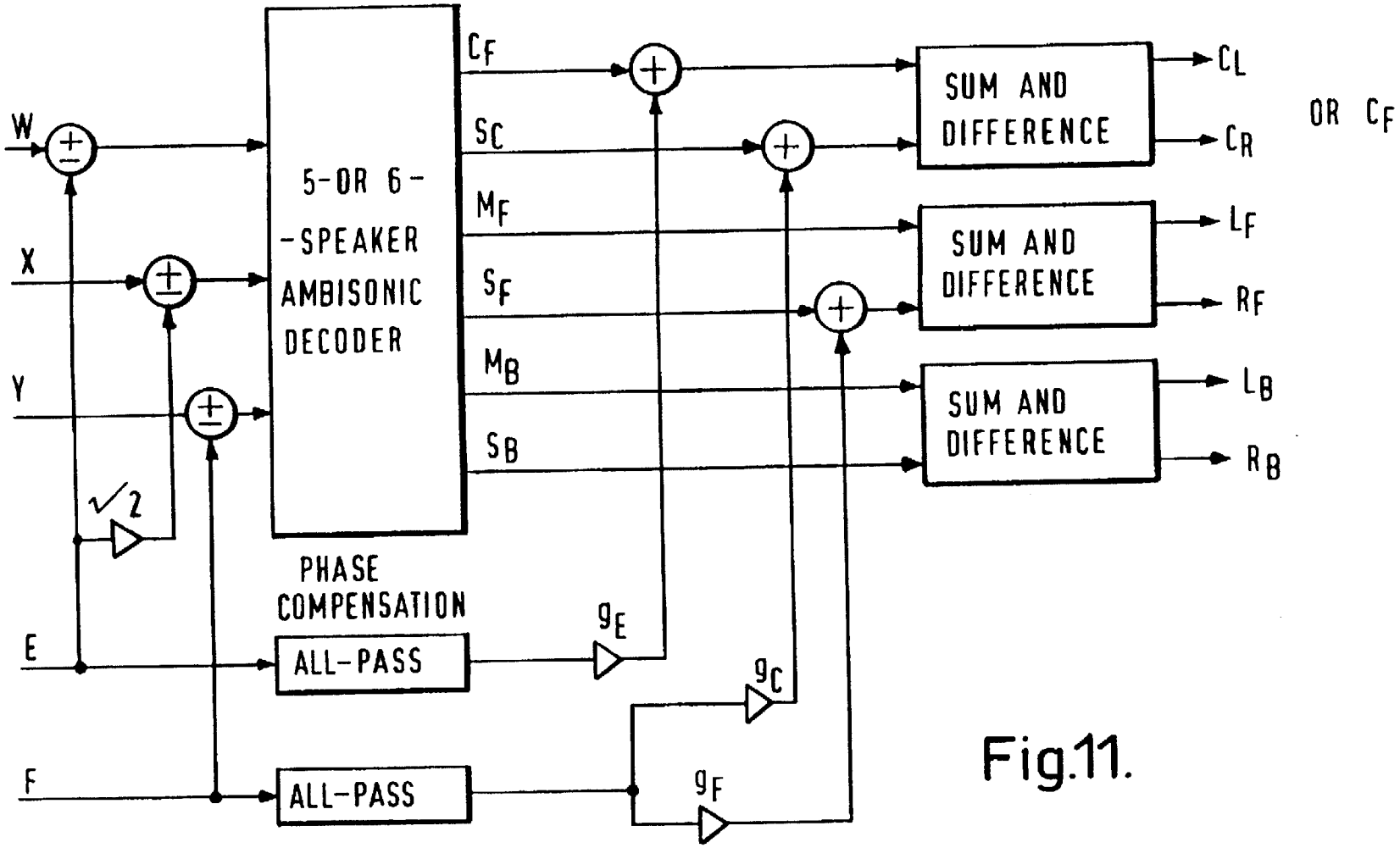
FIG. 11 shows the architecture of a decoder for an enhanced Ambisonic signal incorporating E & F channels.

For Ambisonic reproduction via 5 or 6 loudspeakers, FIG. 11 shows a typical architecture for decoding enhanced B-format signals incorporating an Ambisonic decoding algorithm as described earlier for pure B-format signals. Across the frontal stage for $k_e=k_f=1$, it will be seen that F=Y and it will further be seen that for front centre sounds, W=E and $X=2^{1/2}E$. Thus the signals $$W-E$$

$$X-2^{1/2}E$$

and $$Y-F \tag{54}$$

equal zero and cancel for due front sounds, and Y−F continues to cancel across the rest of the frontal stage, whereas, as θ increases towards 60° and the gain of E falls to zero and then becomes negative, the other two of the signals of equation (54) become large, but in a manner that causes very little output from rear speakers.

Thus the first step in an Enhanced B-format Ambisonic decoder is to derive the "cancelled" signals of equation (54) to feed a conventional 5- or 6- (or greater) speaker B-format Ambisonic decoder, and to take the E signal and to feed it with an appropriately chosen gain via a phase-compensating all-pass network (to match the filter networks in the Ambisonic decoder) to feed centre front loudspeakers directly.

For azimuth zero sounds with $k_e=1$, this gives ideal localisation of centre front sounds. For sounds at other azimuths, the change of the sign of E's gain towards the edges of the frontal stage mean that the directly fed E signal now tends to cancel the centre-front speaker feeds deriving from the output of the B-format Ambisonic decoder, leaving largely just the front left and right speaker feeds. If one then provides the frontal speakers with a multiple of the F signal (passed through another phase-compensating all-pass network) as a left/right difference signal, the width of this largely frontal stage reproduction can be given a desired degree of left/right separation.

By this means, the architecture of FIG. 11, with initial "cancellation" of the enhancement channels E and F from the B-format signals before these are Ambisonically decoded, and the provision of direct speaker feed signals, via phase compensation networks, from E and F, can provide substantially conventional 3-speaker stereo from frontal-stage sounds with $k_e=k_f=1$, with relatively low crosstalk onto rear speakers, provided that the Ambisonic decoder design is a type having additional frontal stage speakers of the kind described above such as in FIGS. 6 to 10. The cancellation by E of a central speaker feed for encoded azimuths near ±60° can be adjusted for a given decoder design by a careful choice of the direct speaker feed gains of the E signal. In particular, while FIG. 11 shows the E and F signals as being simply fed forward and mixed into the $C_F$, $S_C$ and $S_F$ signal paths in a manner that is (apart from phase compensation) independent of frequency, in a practical design, a judicious feed of a small amount of E signal to the $M_F$ and $M_B$ signal paths, and of the F signal to the $S_B$ signal path in small amounts, possibly with a frequency dependence in the gain, can yield a small but useful improvement in the overall performance of front-stage stereo sounds.

It will this be seen that the diagram of FIG. 11 illustrates the structure of an enhanced B-format decoder only in its most basic form, and that slightly more complex direct feeds of the E and F signals, with the dominant components feeding respectively $C_F$ and $S_C$ and $S_F$ may be used to optimise front-stage performance, possibly using gains that vary somewhat with frequency.

In typical 5-speaker decoders, it is found that the gain of the E signal fed to $C_F$ is typically around $g_E=2$, and the gain $f_F$ of the F signal fed to $S_F$ is typically around 1 to ensure broadly "discrete" frontal 3-speaker stereo. These figures vary somewhat with the Ambisonic decoder design and speaker layout.

The function of the E signal is to increase the "separateness" of the frontal speaker feeds, especially that of centre-front, whereas the F signal has the effect of cancelling out the left/right difference signal from the rear speakers and increasing it at the front, thereby converting signals from true Ambisonic surround-sound signals to ones dominantly reproduced from a frontal stage.

The gains $k_e$ and $k_f$ that give predominantly discrete speaker feeds at the front are around 1, and if one wishes to keep rear speaker levels low for frontal stage sounds, it is desirable to put $k_f=1$. However, in general, an improved localisation quality of phantom front-stage images is typically achieved not with $k_e=1$, but with $k_e$ having a value near 0.4 or 0.5, as is shown by computed values of $\theta_v$ and $\theta_E$ for decoders of the form of FIG. 11.

The design of the best direct gains for the E and F signals for each B-format Ambisonic decoding design, for each speaker layout, is a matter of subjective tradeoffs of different aspects of frontal-stage localisation quality by the designer, and does not form a strict part of the system standards for enhanced B-format, but rather a decoding option that may be varied within quite wide limits. It is, of course, necessary to ensure that reasonable results can be obtained, and the basic architecture of FIG. 11 based on the 5- or 6-speaker Ambisonic B-format decoders described in this specification, or its minor modifications suggested above, does broadly achieve the desired results of enhanced frontal-stage image stability very similar to the use of separate frontal-stage stereo transmission channels, while still incorporating full B-format surround sound signals in an economical manner.

While the above has explained how decoders using additional channels E and F similar to those shown in FIG. 11 provide a greater "discreteness" and separation of front-stage azimuthal sound with $|\theta|\geqq\theta_S$, the same method also reduces rear-to-front stage crosstalk across the rear stage azimuths $|180°-\theta|\leqq\theta_B$ when $k_b$ has a value near one. This is because the subtraction of F from Y in such a rear stage has the effect of doubling the gain of Y, thereby increasing the left/right difference signal across both front and rear stages by a factor 2, and the addition of substantially F to the front stage difference signal cancels out the contribution F and Y to the front stage.

It will be appreciated that instead of subtracting F from Y at the input stage of the decoder of FIG. 11, it may instead by preferred to add or subtract the F signal, after passage through a phase-compensating network to match the phase of the bandsplitting filters, with various coefficients directly to the signals $S_C$, $S_F$, and $S_B$ so as to achieve a similar effect. Similarly, the subtraction of E at the input stages of FIG. 11 may be replaced, in whole or in part, by appropriate additions or subtractions of multiples of E, after phase-compensation filtering, to $C_F$, $M_F$ and $M_B$.

Figure 12:
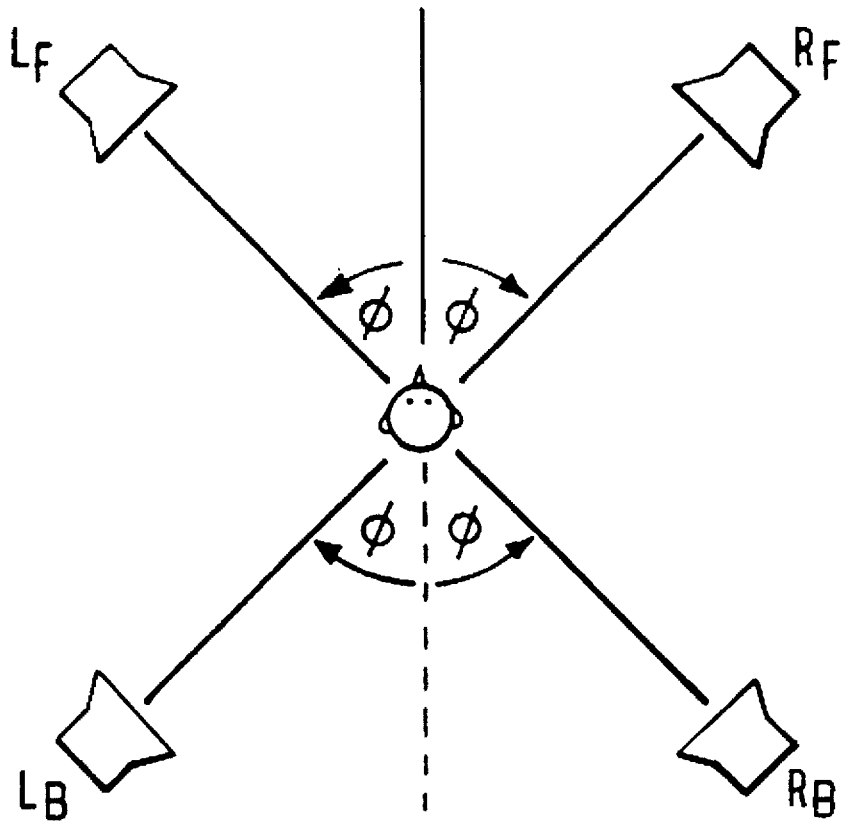
FIG. 12 shows a rectangular speaker layout.

The invention may also be applied to signals encoded by methods other than B-format, and in particular to a directionally encoded signal conveyed via two channel encoding, such as the two-channel surround-sound systems known as UHJ, BMX or regular matrix. One example of such an ambisonic decoder according to the invention for a rectangular loudspeaker layout illustrated in FIG. 12 is now described, although the methods here may be applied to more complicated loudspeaker layouts also.

One method of encoding sounds assigned an azimuthal direction θ into two audio signal channels is that used in the BMX system of encoding, whereby a first signal M is encoded with gain 1 for all azimuths, and a second signal S is encoded with complex-valued gain $$e^{j\theta}=\cos\theta+j\sin\theta \tag{X1}$$

where $j=\sqrt{-1}$ represents a relative 90° shift or Hilbert Transform. The 2-channel example described here will be described in terms of BMX encoding, although it will be realised that similar methods apply to other 2-channel encoding methods.

The psychoacoustic localisation theory described earlier can be applied to loudspeaker signals with complex gains rather than real gains $g_i$ by putting $$r_v\cos\theta_v=Re[V_x/P]$$

$$r_v\sin\theta_v=Re[V_y/P \tag{X2}$$

using the saw notations for P, $V_x$ and $V_y$ in equations (5), (6x) and (6y) earlier, where Re means "the real part of". $r_v$ and $\theta_v$ in this case have similar psychoacoustic interpretations as in the case that $g_i$ are all real gains. The equations (8) to (10) above may still be used to compute the localisation parameters $r_E$ and $\theta_E$ as before, and the equations (11) and (13) still define the desirable ambisonic decoding equations that we ideally wish a decoder to satisfy.

A new factor that must be considered for decoders with complex speaker feed gains $g_i$ is the perceived "phasiness" of signals. Phasiness is an unpleasant subjective effect caused by phase differences between loudspeakers, which causes broadening of illusory sound images, an unpleasant change in perceived tonal quality, and an unplesant "pressure on the ears" sensation. For a forward-facing listener, the degree of phasiness effect may be quantified by the quantity $$q=Im[V_y/P \tag{X3}$$

where Im means "the real coefficient of the imaginary part of".

While subjective sensitivity to phasiness varies among individual listeners, it is found that the effect is objectionable if the magnitude of q exceeds about 0.4, and is usually acceptable if the magnitude of q is less than about 0.2. It is further found that generally, phasiness is more objectionable for frontal stage sounds than for rear stage sounds, so that it is generally preferred that decoder designs be biased to producing a frontal stage phasiness of less than 0.2 magnitude, even if this should mean a quite large phasiness in the rear stage.

In the previous art described by one of the inventors' British patent number 1550627, a means was described of reducing phasiness for 2-channel ambisonic decoders using rectangular or other loudspeaker layouts across a frontal stage, at the expense of increasing it across a rear stage. The present invention, applied to 2-channel ambisonic decoders, allows a lower phasiness and an increased value of $r_E$ to be achieved across the surround sound stage than was possible with this previous art.

As noted earlier, in the previous ambisonic decoder art, the reproduced pressure signal P was substantially a single signal subjected only to a shelf filtering process to meet the requirements of lower and higher frequency localisation, whereas the present decoder uses a pressure signal P whose polar diagram varies substantially with frequency, thereby achieving at higher frequencies, a value of $r_v$ that is not constant with encoded azimuth, but which instead roughly tracks the variation of $r_E$ with encoded azimuth.

Denoting the respective rear left, front left, front right and rear right loudspeaker feed gain by the symbols $L_B$, $L_F$, $R_F$ and $R_B$ as in FIG. 12, and denoting the respective loudspeaker azimuths with respect to a central listener by 180°−φ, φ, −φ and −180°+φ, where φ is the half-width of the stage subtended by the front speaker pair, one can design decoders for this speaker layout as follows. First write $$W_d=\tfrac{1}{2}(L_B+L_F+R_F+R_B)$$
$$X_d=\tfrac{1}{2}(-L_B+L_F+R_F+R_B)$$
$$Y_d=\tfrac{1}{2}(L_B+L_F-R_F-R_B)$$
$$F_d=\tfrac{1}{2}(-L_B+L_F-R_F+R_B) \quad \text{(X4)}$$

Then it can be shown that $\theta_v=\theta_E$ if one puts $F_d=0$, and that in this case $$r_v\cos\theta_v=Re(X_d/W_d)\cos\phi$$
$$r_v\sin\theta_v=Re(Y_d/W_d)\sin\phi$$
$$q=Im(Y_d/W_d)\sin\phi \quad \text{(X5)}$$

and that further $$L_B=\tfrac{1}{2}(W_d-X_d+Y_d)$$
$$L_F=\tfrac{1}{2}(W_d+X_d+Y_d)$$
$$R_F=\tfrac{1}{2}(W_d+X_d-Y_d)$$
$$R_B=\tfrac{1}{2}(W_d-X_d-Y_d) \quad \text{(X6)}$$

Moreover, in this case that $F_d=0$ it can be shown that $$P=2W_d,\ V_x=2X_d\cos\phi,\ v_y=yY_d\sin\phi \quad \text{(X7)}$$

and that $$E=|W_d|^2+|X_d|^2+|Y_d|^2$$
$$E_x=2(\cos\phi)Re(X_d\ W_d^*)$$
$$E_y=2(\sin\phi)Re(Y_d\ W_d^*) \quad \text{(X8)}$$

where * indicates complex conjugation. From these results, the "psychoacoustic localisation parameters" $r_v$, $r_E$, $\theta_v=\theta_E$ and q can be computed via $$r_v\cos\theta_v=\tfrac{1}{2}(E_x/|W_d|^2)$$
$$r_v\sin\theta_v=\tfrac{1}{2}(E_y/|W_d|^2) \quad \text{(X9)}$$

so that $$r_v=(E_x^2+E_y^2)^{1/2}/(2|W_d|^2) \quad \text{(X10)}$$

and $$r_E=(2|W_d|^2)\,r_v/E=2r_v/\left(1+\left|\frac{X_d}{W_d}\right|^2+\left|\frac{Y_d}{W_d}\right|^2\right). \quad \text{(X11)}$$

Figure 13:
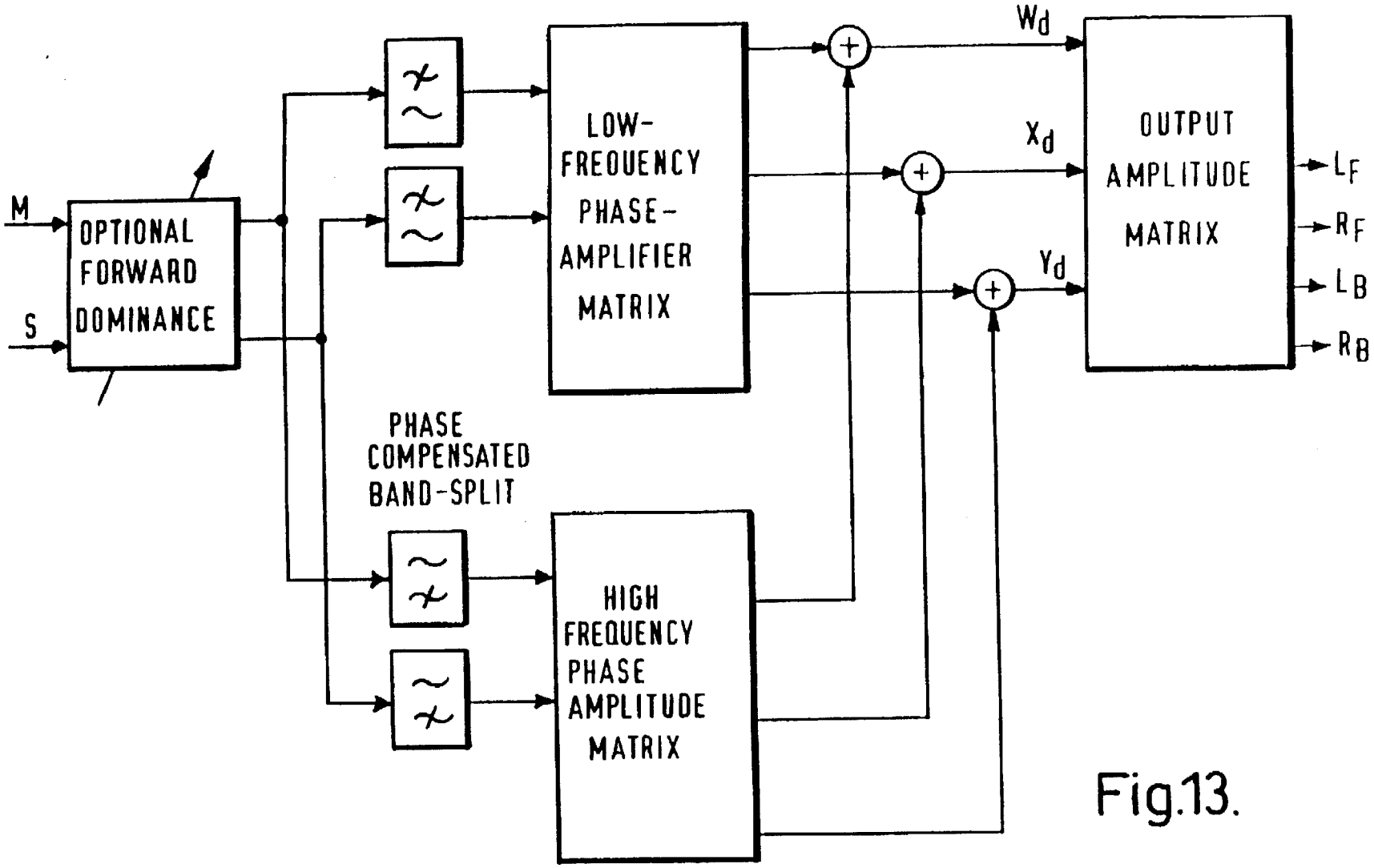
FIG. 13 shows a 2-channel Ambisonic decoder for the layout of FIG. 12.

FIG. 13 shows an example of an ambisonic decoder for a rectangular speaker layout, which provides signals $W_d$, $X_d$, and $Y_d$ derived via phase-amplitude matrices from input signals M and S, in two separate signals paths at low and at high audio frequencies (typically with a cross-over frequency around 400 Hz) produced from the input signals via phase-compensated band splitting filters as described earlier in connection with FIG. 10. Such low and high frequency signals $W_d$, $X_d$ and $Y_d$ may then be fed to an output amplitude matrix, such as in equ. (X6) above, to derive output loudspeaker feed signals suitable for a layout such as shown in FIG. 12.

By using two phase-amplitude matrices for the two audio frequency ranges, it is thereby possible to optimise $r_v$ to equal 1 in the low frequency range and to use a different matrix so as to maximise $r_E$ and to minimise the effects of phasiness q in the higher frequency range. It will be appreciated that the band splitting filters need not preceed the phase amplitude matrices, but may alternatively follow them or be placed in the middle of the signal path of the matrices. In particular, in practical implementations, it is often convenient for the relative 90° difference networks, which are relatively complex and which form a part of any phase-amplitude matrix, to precede the bandsplitting filters.

Also shown in FIG. 12 is an optional "forward dominance" adjustment, which in general will differ from that for B format given earlier, but which performs a similar function of altering the gains and azimuthal distributions of different encoded azimuth directions while maintaining the characteristics of the particular locus of encoded directions characterising the directional encoding scheme for which the decoder is designed.

In the prior art, as described in British patents 1494751, 1494752 and 1550627, there is a known solution to the ambisonic decoding equations for which $\theta=\theta_v=\theta_E$ for BMX, which may be characterised in terms of the above signals $W_d$, $X_d$ and $Y_d$ as follows. Put x=cosθ and y=sinθ, so that $e^{j\theta}=x+jy$. Then the prior art solution is $$W_d=k_0{}^1=k_0M$$
$$X_d=k_1(x+jy)/\cos\phi=k_1S/\cos\phi$$
$$Y_d=k_1(y-jx)+k_3j1|/\sin\phi$$
$$=[-k_1jS+k_3jM]/\sin\phi, \quad \text{(X12)}$$

where the real gain constants $k_0$, $k_1$ and $k_3$ are frequency dependent, with $k_0=k_1$ at low frequencies to ensure that $r_v=1$, and with $k_1$ equal to between 0.5 and 0.7 times $k_0$ at high frequencies, with $k_3$ equal to about $\tfrac{1}{2}k_1$ to help maximise $r_E$ and minimise phasiness q.

It will be noted in particular that in this prior art solution, in each frequency range $r_v$ is independent of encoded azimuth θ, being equal to $k_1/k_0$, and that the pressure signal $P=2W_d$ is simply the signal M subjected to a frequency-dependent gain $k_0$, without any variation of polar diagram to encoded azimuth θ as frequency varies.

We have found new solutions of the ambisonic decoding equations for BMX for which $\theta=\theta_v=\theta_E$. These have the form $$W_d=t_1M+t_2S=t_1^1+t_2(x+jy)$$

$$X_d=k_1(-t_2M+t_1S)/\cos\phi=k_1(-t_2^1+t_1(x+jy))/\cos\phi$$

$$Y_d=(-k_2jS+k_3jM)/\sin\phi=[k_2(y-jx)+k_3j]/\sin\phi, \quad \text{(X13)}$$

where $t_1$, $t_2$, $k_1$, $k_2$ and $k_3$ are 5 real parameters chosen such that $$r_v\cos\theta_v=k_1(t_1^2-t_2^2)x/(t_1^2+t_2^2+2t_1t_2x)=r_vx \quad \text{(X14)}$$

and $$r_v\sin\theta_v=(k_3t_2+k_2t_1)y/(t_1^2+t_2^2+2t_1t_2x)=r_vy, \quad \text{(X15)}$$

so as to give $\theta=\theta_V=\theta_E$.

This is ensured by requiring that $$k_3t_2+k_2t_1=k_1(t_1^2-t_2^2). \quad \text{(X16)}$$

With this equation, the new BMX solution to the ambisonic decoding equation $\theta=\theta_v=\theta_E$ has four free real parameters, one of which merely represents the overall reproduced gain. If $t_2\neq0$, these solutions differ from the prior art, and if the ratio of $t_2$ to $t_1$ varies with frequency, the resulting decoder has a pressure signal P whose polar diagram varies with frequency and such that $r_v$ varies with azimuth $\theta$.

Solutions with $r_v=1$ are given whenever $$t_2=0,\ k_1=1$$

and $$k_2=t_1, \quad \text{(X17)}$$

for any choice of $k_3$, and such solutions are apt to the low frequency audio region as explained earlier. At high frequencies, it is found to be better that $t_2\neq0$. Typically, the pressure signal gain $P=2W_d$ is chosen such that at low frequencies it tends to have an omnidirectional polar pattern, but at high frequencies it is more sensitive to the back than to the front.

The phasiness of this decoder is given by $$q=[(k_3t_1-k_2t_2)+(k_3t_2k_2t_1)x]/(t_1^2+t_2^2+2t_1t_2x). \quad \text{(X18)}$$

We have found that the following values give a BMX decoder with excellent high frequency performance:

$$t_1=1,\ t_2=-0.15,\ k_1=0.5,\ k_2=0.53915,\ k_3=0.3360 \quad \text{(X19)}$$

which satisfy the equation (X16) above, and also ensure that $q=0$ for $\theta=\pm45°$ azimuth, thereby helping to minimise phasiness across a frontal azimuthal stage.

The values of the localisation parameters and total reproduced energy gain for this high frequency BMX decoder for various encoded azimuths $\theta$ are given in the following table for a square speaker layout.

| $\Theta=\Theta_V=\Theta_E$ | $r_V$ | q | $r_E$ | gain dB |
|---|---|---|---|---|
| 0° | 0.6765 | −0.2390 | 0.6666 | 1.66 |
| 45° | 0.6031 | 0.0000 | 0.5675 | 2.36 |
| 90° | 0.4780 | 0.4077 | 0.4176 | 3.69 |
| 135° | 0.3959 | 0.6753 | 0.3303 | 4.71 |
| 180° | 0.3696 | 0.7610 | 0.3040 | 5.07 |

with similar results for negative azimuths because of left/right symmetry.

Compared to prior art BMX decoders via square loudspeaker layouts, this decoder gives a lower rear-stage phasiness for given values of $r_E$.

Note from the above table that the values of $r_E$ and $r_v$ more-or-less track as azimuth varies, which we have found to be generally desirable for good performance in ambisonic decoder designs.

It will be noted that the reproduced gain in the above table varies with azimuth. As in the earlier B-format examples of the invention, a suitable forward dominance transformation may be used prior to decoding, as shown in FIG. 13,to compensate for such gain variation. A forward dominance transformation that preserves BMX encoding is given by the amplitude matrix transformation $$M'=\tfrac{1}{2}(1+w)M+\tfrac{1}{2}(1-w)S$$

$$S'=\tfrac{1}{2}(1-w)M+\tfrac{1}{2}(1+w)S, \quad \text{(X20)}$$

where w is a positive parameter. This has the effect of leaving $\theta=0°$ sounds with unchanged gains, but of multiplying the amplitude gain of rear $\theta=180°$ sounds by a factor w, and also of altering encoded azimuths $\theta$ to a new azimuth $\theta'$ given by the formula equ. (4a) where $\mu$ is now given by:

$$\mu=(1-w^2)/(1+w^2) \quad \text{(X21)}$$

As in the B-format case, the forward dominance matrix may be combined with the phase-amplitude matrices.

The above BMX decoder is not only applicable to use with rectangular loudspeaker layouts, since the output amplitude matrix in FIG. 13 may be replaced with alternative output amplitude matrices described in the prior art in British patents 1494751, 1494752, 1550627 and 2073556 for regular polygon, regular polyhedron or other loudspeaker layouts comprising diametrically opposed pairs of loudspeakers.

While BMX encoding has been used in the above description for ease of description, the same decoding method can be used with other 2-channel directional coding methods, and in particular with conventional amplitude-panned stereophony. In this case, left and right speaker feed signals L and R may be converted into BMX signals M and S suitable for the above decoder by means of a phase-amplitude matrix $$M=(L+R)+jw(L-R)$$

$$S=(L+R)-jw(L-R) \quad \text{(X22)}$$

or by a phase-amplitude matrix $$M=(L+R)-jw(L-R)$$

$$S=(L+R)+jw(L-R), \quad \text{(X23)}$$

where w is a positive stage width parameter which may be predetermined or adjustable by the user. Again, this matrix may be combined with the phase-amplitude matrices shown in FIG. 13.

The above-described decoder for conventional stereophony may also be used with signals encoded for the Dolby 2-channel cinema encoding method with advantageous results, and for signals encoded for regular matrix encoding.

While, for simplicity of description, the 2-channel example of the invention has been discussed only in connection with regular loudspeaker layouts, more complicated loudspeaker layouts such as those shown in FIGS. 6 to 9 may also be used, in which the signals P, $V_x$ and $V_y$ have the forms already given in connection with equation (X13) and (X16) for BMX, i.e. such that equ. (X16) hold and such that $$P=2[t_1+t_2(x+jy)]$$
$$V_x=2k_1(-t_2+t_1(x+jy))$$
$$V_y=2[k_2(y-jx)+k_3j] \quad \text{(X24)}$$

and in which other linear combinations of loudspeaker feed signal gains are adjusted so as to ensure that $\theta_E=\theta_V$. By this means, decoders for 2-channel surround-sound encoded signals may be devised which feed 5- or 6-speaker layouts such as shown in FIGS. 6 to 9 and which satisfy the ambisonic decoding equations.

Figure 14:
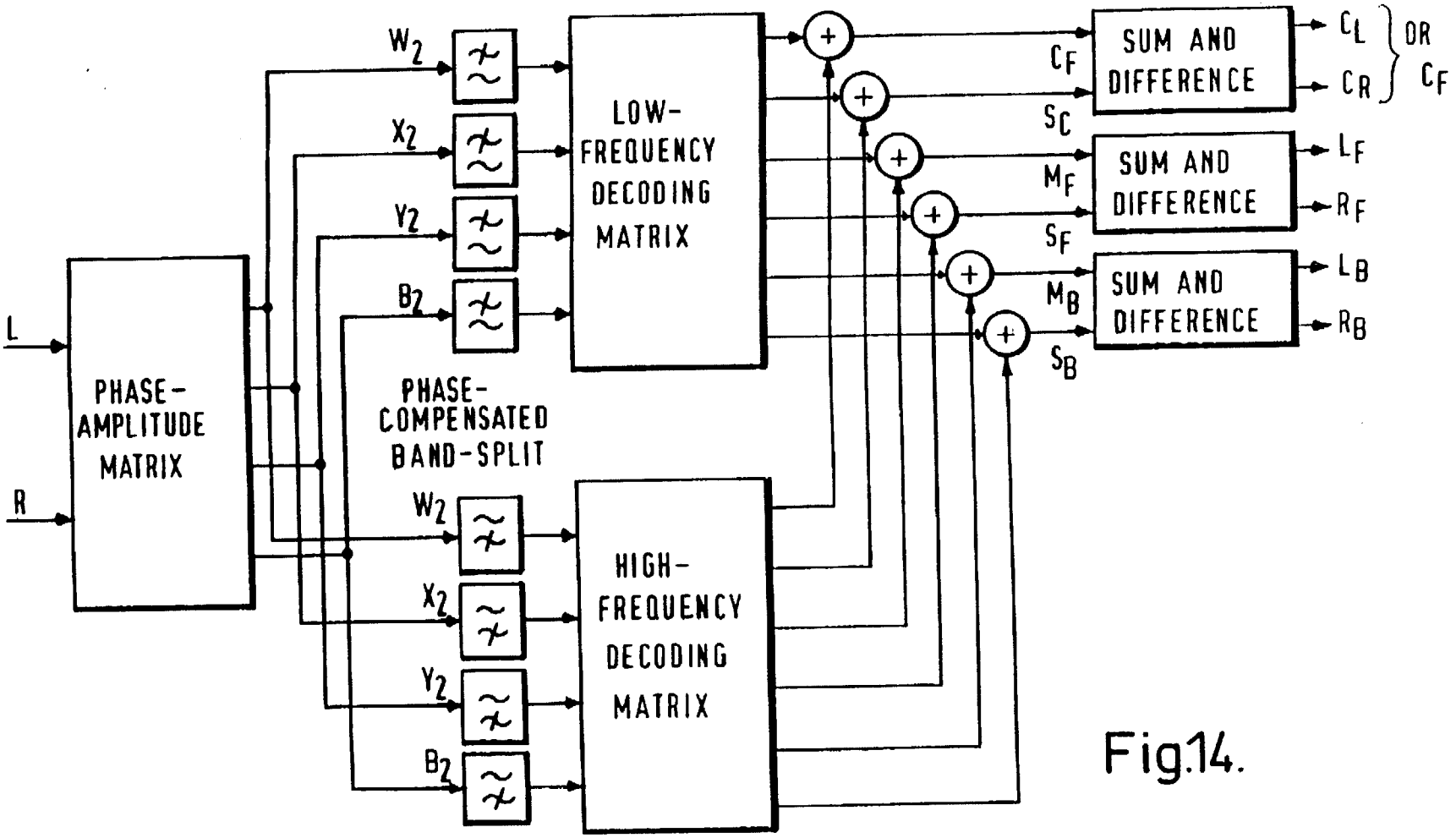
FIG. 14 shows an example of a 2-channel Ambisonic decoder.

FIG. 14 shows the block diagram of a typical 2-channel decoder satisfying the ambisonic decoding equations and capable of feeding five or six loudspeakers arranged as in FIGS. 6 to 9. It will be seen that such a decoder is broadly similar to the B-format decoder of FIG. 10, except that it is fed by a 2-channel encoded signal, which is then fed to a first phase amplitude matrix which provides four output signal components $W_2$, $X_2$, $Y_2$ and $B_2$ which typically represent "pressure", "forward component of velocity", "leftward component of velocity" and "pressure phase shifted by 90°" signals, and these four signals are then bandsplit via phase compensated low and high pass filters and fed into respective low- and high-frequency amplitude matrices. The outputs of these matrices are then handled in an identical manner to that already described in connection with the later stages of FIG. 10.

The four signal components are, in typical implementations, related by $B_2$ being a nonzero imaginary multiple of $W_2$ and by $Y_2$ being a nonzero imaginary multiple of $X_2$, and by being such that $W_2$ and $X_2$ are "left/right symmetric" encoded signals in the sense that their gains as a function of encoded azimuth 6 satisfy $$W_2(-\theta)=[W_2(\theta)]^*$$
$$X_2(-\theta)=[X_2(\theta)]^*, \quad \text{(X25)}$$

typically having the form $$W_2(\theta)=a_1+a_2\cos\theta+a_3j\sin\theta$$
$$X_2(\theta)=b_1+b_2\cos\theta+b_3j\sin\theta, \quad \text{(X26)}$$

where $a_1$, $a_2$, $a_3$, $b_1$, $b_2$ and $b_3$ are real coefficients.

For example, in the BMX case, one may have $$W_2=M,\ X_2=S,\ Y_2=-jS,\ B_2=jM. \quad \text{(X27)}$$

For such signals $W_2$, $X_2$, $Y_2$ and $B_2$, the low- and high-frequency amplitude matrices in FIG. 14 will then have the form $$C_F=a_CW_2+b_CX_2$$
$$M_F=a_FW_2+b_FX_2$$
$$M_B=a_BW_2+b_BX_2$$
$$S_C=k_CY_2+1_CB_2$$
$$S_F=k_FY_2+1_FB_2$$
$$S_B=k_BY_2+1_BB_2 \quad \text{(X28)}$$

where $a_C$, $b_C$, $a_F$, $b_F$, $a_B$, $b_B$, $k_C$, $l_C$, $k_F$, $l_F$, $k_B$ and $l_B$ are real coefficients, by analogy with equations (27) in the B-format case, and where the output amplitude matrix in FIG. 14 is given by equations (26) as in the B-format case.

It will thus be seen that in the two channel case, the broad architecture of a decoder satisfying the ambisonic decoding equations is similar to the three channel B-format case, except that an input phase-amplitude matrix produces four signal components to be processed rather than three. Because much of the signal processing is similar, large parts of the signal processing circuitry or algorithm may be common to use for decoding from different 2-channel and 3-channel sources.

We now indicate how new decoder solutions according to the invention may be derived for 2-channel directional encoding systems other than BMX, including the UHJ system. We consider systems of en coding sounds into a 360 degree range of direction angles θ, where typically and for convenience of description, θ is measured anticlockwise in the horizontal plane from the forward direction.

Such systems encode directional sound into two independent linear combinations (for example the sum $L=\Sigma+\Delta$ and the difference $R=\Sigma-\Delta$) of signals Σ and Δ with respective gains $$\Sigma=a+bx+jcy$$
$$\Delta=jd+jex+fy \quad \text{(X-29)}$$

where a,b,c,d,e,f are real coefficients and where $x=\cos\theta$ and $y=\sin\theta$. For example, in the UHJ 2-channel encoding system described in M. A. Gerzon, "Ambisonics in Multichannel Broadcasting and Video", J. Audio Eng. Soc., vol. 33 no. 11, pp. 859–871 (1985 November), one has $$a=0.9397,\ b=0.2624,\ c=0$$
$$d=-0.1432,\ e=0.7211,\ f=0.9269. \quad \text{(X-30)}$$

Since such directional encoding systems use only 2 channels, all signals used in decoders are complex linear combinations of just two signal components, which we shall denote as $W_2$ and $X_2$ analogous in the general case to signals with gains 1 and x+jy in the special case already described of BMX. The analogous signals $W_2$ and $X_2$ are conveniently chosen to be those signals used for the pressure and forward-facing velocity components of a 2-channel decoding system disclosed in one of the inventors British patent 1550628 for a system with 2-channel encoding equations (X-29). The signal $X_2$ may be multiplied by a real constant times j to obtain a signal $Y_2$ and the signal $W_2$ may be multiplied by a real constant times j to obtain a signal $B_2$ suitable for use in a decoder for 2-channel encoded signals according to the invention having the form shown in FIG. 14.

By way of example of a decoder according to the invention for a more general encoding system of the form (X-29), consider the case where the encoding system signals are linear combinations of signals $W_2$ and $X_2$ with respective gains $$W_2=1,\ X_2=x+jBy \tag{X-31}$$

which generalises the BMX case by having a real factor B not necessarily equal to ±1, although in most cases its magnitude will be fairly near 1 in value, for example in the range 0.7 to 1.4.

In this case, we may implement a decoder according to the invention for which $$P=t_1^{1+}t_2(x+jBy)$$

$$v_x=k_1\{-t_3^{1+}t_4(x+jBy)\}$$

$$v_y=k_1\{k_2(y-jB^{-1}x)+k_3j1\} \tag{X-32}$$

which are all complex linear combinations of $W_2$ and $X_2$. In the case of decoders of the form of FIG. 13 for the same rectangular loudspeaker layout of FIG. 12 described in the BMX case, this may be done by putting $$W_d=t_1^{1+t}{}_2(x+jBy)$$

$$X_d=k_1\{-t_3^{1+t}{}_4(x+jBy)\}/\cos\theta$$

$$Y_d=k_1\{k_2(y-jB^{-1}x)+k_3j1\}/\sin\phi$$

$$F_d=0, \tag{X-33}$$

which is a generalised version of equations (X13) of the BMX case, except that here we have chosen to normalise $k_2$ and $k_3$ differently by taking out an additional factor $k_1$; this is purely a matter of analytic convenience in the following.

Prior art known decoders for such encoded signals that gave correct decoded azimuth θ, i.e. that had $$Re[v_x/P]:Re[v_y/P]=x:y, \tag{X-34}$$

all satisfied $t_2=0$, and hence had a pressure polar diagram that did not vary with frequency, and all satisfied $k_2=t_4$, and thus had, at each frequency, values of $r_v$ which were independent of encoded azimuth. However, as in the BMX case above, the present invention allows decoders to be designed substantially satisfying Eq. (X-34) for which the pressure polar diagram varies with frequency and for which $r_v$ varies significantly (by more than say 5% in value) with encoded signal direction.

Computations using the above formulas then show that $$|X_2|^2=½(1+B^2)+½(1-B^2)(x^2-y^2), \tag{X-35}$$

using the fact that $x^2+y^2=1$ for all directions θ, and that $$Re[v_x/P]=(Re[v_xP^*])/|P|^2$$

$$Re[v_y/P]=(Re[v_yP^*])/|P|^2, \tag{X-36}$$

where $$|P|^2=t_1^2+t_2^{2½}(1+B^2)+t_1^{2½}(1-B^2)(x^2-y^2) \tag{X-37}$$

$$Re[v_xP^*]/k_1=-t_3t_1+t_2t_4^{1/2}(1+B^2)+t_2t_4^{1/2}(1-B^2)(x^2-y^2)+$$

$$(t_1t_4+t_2t_3)x \tag{X-38}$$

$$Re[v_yP^*]/k_1=(k_2t_1+k_3t_2B)y. \tag{X-39}$$

Unlike in the BMX case, making the constant term in Eq. (X-38) zero is not enough to make $Re[v_x/P]:Re[v_y/P]$ proportional to x/y. However, the term $t_2t_4^{1/2}(1-B^2)(x^2-y^2)$ of Eq. (X-38) is zero for azimuths θ=±45° and ±135°, and typically causes only small reproduced azimuth errors for other azimuths (being worst around θ=90°) since the coefficient $t_2t_4^{1/2}(1-B^2)$ is generally small compared to the coefficient $t_1t_4-t_2t_3$ of x.

For this reason, we may ignore the small term $t_2t_4^{1/2}(1-B^2)(x^2-y^2)$ in Eq. (X-38). One then has reproduction of sound substantially in the correct velocity vector azimuth θ if and only if $$Re[v_x/P]:Re[vy/P]=x:y,$$

which is then the case from Eqs. (X-38) and (X-39) if $$-t_3t_1+t_2t_4^{1/2}(1+B^2)=0 \tag{X-40}$$

and $$(t_1y_4-t_2t_3)=(k_2t_1+k_3t_2B). \tag{X-41}$$

Eqs. (X-40) and (X-41) are in turn satisfied if we determine the normalisation factor $k_1$ by putting $$t_4=t_1 \tag{X-42}$$

so that from Eq. (X-40), $$t_3=½(1+B^2)\ t_2 \tag{X-43a}$$

and substituting into Eq. (X-41) we find $$t_1^2-½(1+B^2)t_2^2=k_2t_1+k_3t_2B. \tag{X-43b}$$

Thus Eqs. (X-42) and (X-43a) and (X43b) provide, for $t_2$ not equal 0, a more general solution to decoding $W_2$ and $X_2$ than known in the prior art but sharing substantially the same decoded azimuths. At low frequencies, where it is desirable that $r_v=1$, the older known solutions with $t_2=0$ may be used, and at higher frequencies above a psychoacoustically determined cross-over frequency in the region typically of 400 Hz, the decoder may use a nonzero value of $t_2$ giving a value of $r_v$ which varies with direction, preferably being chosen so as to be larger across the frontal stage of encoded directions than across the rear stage, as in the BMX example given above.

We may rewrite equations (X-33) as $$W_d=t_1W_2+t_2X_2$$

$$X_d=k_1\{-t_3W_2+t_4X_2\}/\cos\phi$$

$$Y_d=k_1\{k_2Y_2+k_3B_2\}/\sin\phi$$

$$F_d=0, \tag{X-44}$$

where $W_2$, $X_2$, $Y_2=-jB^{-1}X_2$, $B_2=jW_2$ are of the general form described above for general decoders of FIG. 14 for 2-channel directional encoding.

Although the UHJ encoding system does not strictly satisfy equations (X-31), it may be decoded in a similar way using $$W_2=0.982\Sigma+0.164j\Delta$$

$$X_2=0.419\Sigma-0.828j\Delta$$

where a value B=−1.085 approximately gives a satisfactory directional decoding.

It will be seen that for any 2-channel decoder satisfying Eqs. (X-32) or Eqs. (X-28) that the pressure signal is of the general form $$P=a_W{}^{1+b}{}_Wx+jc_Wy \tag{X-45}$$

and that the velocity signals $v_x$ and $v_y$ are of the general form $$V_x=a_X{}^1+b_Xx+jc_Xy \tag{X-46}$$

$$v_y=-ja_Y1-jb_Yx+C_Yy \tag{X-47}$$

where the coefficients $a_W$, $b_W$, $c_W$, $a_X$, $b_X$, $c_X$, $a_Y$, $b_Y$ and $c_Y$ are all real. It is desirable for 2-channel directional encoding systems having the form indicated in Eqs. (X-29) that reproduced pressure and velocity gains be of the general form of Eqs. (X-45) to (X-47) if the results are to have a desirable left/right symmetry.

In general, decoders for 2-channel encoded signals of the form of Eqs. (X-29) having larger $r_V$ and $r_E$ across a frontal stage than across a rear stage will, as in the BMX example given earlier, have an undesirable gain variation with direction, with the less well localised rear stage sounds being reproduced with louder energy than the frontal stage. As in both the B-format and the BMX cases considered earlier, it is possible to subject the encoded 2-channel signals to a linear transformation which has very little effect on the encoding specification of directions except that the directions themselves are altered slightly and changed in gain. In the case of encoded signals $W_2$, $X_2$ of the form of Eqs. (X-31), such a transformation produces transformed signals $W_2'$, $X_2'$ of the form $$W_2'=\tfrac{1}{2}(1+w)W_2+\tfrac{1}{2}(1-w)X_2$$

$$X_2'=\tfrac{1}{2}(1-w)W_2+\tfrac{1}{2}(1+w)X_2 \tag{X-48}$$

similar to Eq. (X-20) for BMX, where w is a positive parameter, and where w<1 if is desired to increase gains of sounds at the front and reduce them at the back.

In a decoder, transformed signals $W_2'$, $X_2'$ may replace $W_2$ and $X_2$, for example in Eqs. (X-44), whenever it is desired to adjust the reproduced directional gains. While this directional transformation may be implemented as a complex 2×2 matrix on the directionally encoded signals before decoding, it is generally preferred if this matrix is either combined with the phase amplitude matrix in the decoder that derives the signals fed to the low and high frequency amplitude decoding matrices, or is implemented as a real linear matrix on signals such as $W_2$, $X_2$, $Y_2$ and $B_2$. Such preferred implementations avoid having to use additional phase amplitude matrixing, which is generally more costly and harder to do well than simple amplitude matrixing, due to the use of and need for relative 90 degree phase difference networks.

The invention may be applied using the methods and principles described in more complicated cases than those decoders explicitly described in the examples. For example, the invention may be used with loudspeaker layouts having seven, eight, nine or more loudspeakers disposed in a left/right symmetrical arrangement around a listening area. The structure of such decoders is identical to that described with reference to FIGS. 10, 11 and 14, except that additional pairs of signals $M_i$ and $S_i$ are provided for feeding any left/right symmetric additional pairs $L_i$ and $R_i$ of speakers.

Such layouts with further loudspeakers again preferably have a greater number of loudspeakers across the frontal reproduced stage than across the rear reproduced stage so that the reproduced value of $r_E$ is larger for frontal stage sounds than for rear stage sounds, and again it is preferred that the values of $r_v$ and $r_E$ as a function of encoded sound direction should roughly track each other.

With such increased numbers of loudspeakers, the B-format enhancement signals E and F may as before be added to and subtracted from respective $M_i$ and $S_i$ signals so as to increase the separation among front stage loudspeakers and between front and rear stages.

Such decoders are designed by exactly the same methods described in Appendix A and D in the 5 and 6 speaker case.

APPENDIX A

Solving Ambisonic Decoding Equations

We illustrate the method of finding the general left/right symmetric B-format decoder solution to equation (25) with reference to a decoder for the 5-speaker layout of FIG. 7, assuming speaker feed signals of the form given by equations (26) with (27). A direct computation using equations (5), (6), (8) and (9), yields from equations (26)

$$P=C_F+2M_F+2M_B \tag{28a}$$

$$V_x=C_F+2M_F\cos\phi_F-2M_B\cos\phi_B \tag{28b}$$

$$V_y=2S_F\sin\phi_F+2S_B\sin\phi_B \tag{28c}$$

$$E=C_F{}^2+2(M_F{}^2+S_F{}^2+M_B{}^2+S_B{}^2) \tag{29a}$$

$$E_x=C_F{}^2+2(M_F{}^2+S_F{}^2)\cos\phi_F-2(M_B{}^2+S_B{}^2)\cos\phi_B \tag{29b}$$

$$E_y=4M_FS_F\sin\phi_F+4M_BS_B\sin\phi_B, \tag{29c}$$

where, by a slight abuse of notation, we use the same symbols to represent the gains of signals for a given encoding azimuth θ as we do to indicate the signals themselves.

The quantities P, $V_x$ and $V_y$ of equation (28) are all left/right symmetric real linear combinations of W, X and Y. In particular, from equation (7), the requirement that $\theta_v=\theta$ as in equation (25) implies that $$v_x:\ v_y=X:Y, \tag{30a}$$

so that we may put $$V_x=2\tfrac{1}{2}gX \tag{30b}$$

$$V_y=2\tfrac{1}{2}gY \tag{30c}$$

where g is an overall gain factor. In order to simplify the equations following, we shall set $$g=1 \tag{30d}$$

so as to avoid repeating a lot of factors g in the analysis; however, it will be necessary to multiply the overall decoder coefficients thus obtain in equations (27) by an overall gain g afterwards, in order to obtain a desired overall gain of reproduction. In particular, it is desirable to match the gains of low and high frequency Ambisonic decoding matrices so as to ensure a flat overall frequency response.

Substituting equations (28) to (30) into equation (12), we get $$Y[C_F^2+2(M_F^2+S_F^2)\cos\phi_F-2(M_B^2+S_B^2)\cos\phi_B]=4X[M_FS_F\sin\phi_F+M_BS_B\sin\phi_B].$$

substituting $S_F=k_FY$ and $S_B=k_BY$ into this from equations (27), and dividing both sides by Y (which means discarding the exceptional solution Y=0 to equations (25), which only applies for azimuths 0° or 180°), we get $$C_F^2+2(M_F^2+k_F^2Y^2)C_F-2(M_B^2+k_B^2Y^2)C_B=4X[k_FM_Fs_F+k_BM_Bs_B], \quad (31)$$

where to reduce notational clutter, we have written $$C_F=\cos\phi_F,\ s_F=\sin\phi_F$$

$$C_B=\cos\phi_B$$

and $$s_B=\sin\phi_B, \quad (32)$$

But from equation (2), $Y^2=2W^2-X^2$, and from equations (28b), (30b) and (30d), $$C_F=2^{1/2}X-2M_FC_F+2M_BC_B, \quad (32b)$$

so that substituting into equation (31) gives $$(X-2^{1/2}M_FC_F+2^{1/2}M_BC_B)^2+M_F^2C_F-M_B^2C_B+(k_F^2C_F-k_B^2C_B(2W^2-X^2)=2X(k_FM_Fs_F+k_BM_Bs_B),$$

which, for an arbitrary real constant a, may be rewritten in the form $$[M_F^2(2c_F+1)c_F+M_B^2(2c_B-1)c_B-4c_Fc_BM_FM_B]-2X[(k_Fs_F+2^{1/2}c_F)M_F+(k_Bs_B-2^{1/2}c_B)M_B]+\alpha X^2=2(k_B^2c_B-k_F^2c_F)W^2+(\alpha-1+k_F^2c_F-k_B^2c_B)X^2. \quad (33)$$

For a suitable choice of α, to be determined, the left hand side of equation (33) can be factorised, and the right hand side of equation (33) can also be factorised provided only that the coefficients of $W^2$ and $X^2$ are of opposite signs. By setting factors on the two sides equal to each other, we find solutions to the decoding equations (25) which are of the form given by equations (27).

The first step in factorising the left hand side of equation (33) is to factorise the first term in square brackets, i.e. to write it in the form $$(\alpha_FM_F+\alpha_BM_B)(\beta_FM_F+\beta_BM_B), \quad (34)$$

where for convenience we choose to put $$\alpha_F=\beta_F=\sqrt{[(2c_F+1)c_F]}, \quad (35)$$

which is real provided that $|\phi_F|<90°$. Putting $$a=c_F(2c_F+1),\ b=2c_Fc_B$$

and $$c=c_B(2c_B-1) \quad (36)$$

we find by solving a quadratic equation that the factorisation equation (34) equals the first square bracket term on the left hand side of equation (33) provided that $$\alpha_F=\beta_F=\sqrt{a} \quad (37a)$$

$$\alpha_B=[-b-\sqrt{(b^2-ac)}]/\sqrt{a} \quad (37b)$$

$$\beta_B=[-b+\sqrt{(b^2-ac)}]/\sqrt{a} \quad (37c)$$

which are real, so that a factorisation exists, only if $b^2 \geqq ac$.

The left hand side of equation (33) can thus be written in the factorisable form $$(\alpha_FM_F+\alpha_BM_B+\alpha_XX)(\beta_FM_F+\beta_BM_B+\beta_XX) \quad (38)$$

if we have $$\alpha_X\beta_F+\beta_X\alpha_F=-2(k_Fs_F+2^{1/2}c_F) \quad (39a)$$

$$\alpha_X\beta_B+\beta_X\alpha_B=-2(k_Bs_B-2^{1/2}c_B( \quad (39b)$$

and we put $$\alpha=\alpha_X\beta_X. \quad (39c)$$

Given $k_F$ and $k_B$, one can solve the linear equations (39a) and (39b) in $\alpha_X$ and $\beta_X$, giving:

$$\alpha_X=\frac{[-2(k_Fs_F+2^{1/2}c_F)]\alpha_B-[-2(k_Bs_B-2^{1/2}c_B)]\alpha_F}{\beta_F\alpha_B-\beta_B\alpha_F} \quad (40a)$$

$$\beta_X=\frac{[-2(k_Fs_F+2^{1/2}c_F)]\beta_B-[-2(k_Bs_B-2^{1/2}c_B)]\beta_F}{\alpha_F\beta_B-\alpha_B\beta_F}, \quad (40b)$$

from which α can be computed via equation (39c).

Thus, we can factorise both sides of equation (33) and write:

$$(\alpha_FM_F+\alpha_BM_B+\alpha_XX(\beta_FM_F+\beta_BM_B+\beta_XX)=(-C)[\gamma X\pm\delta W]\ (-C)^{-1}(\mathrm{sgn}\Gamma)(\gamma X\pm\delta W] \quad (41)$$

where $$\gamma=\sqrt{|\Gamma|} \quad (42a)$$

where $$\Gamma=\alpha_X\beta_X-1+k_F^2c_F-k_B^2c_B$$

and $$\delta=\sqrt{|2(k_F^2c_F-k_B^2c_B)|} \quad (42b)$$

provided only that the coefficients of $W^2$ and $X^2$ on the right hand side of equation (33) do not have the same sign, where C is an arbitrary nonzero coefficient that can be chosen freely.

If we select a value of $k_F$, then the value of $k_B$ can be computed from equations (28c), (30c) and (27) to be given by $$k_B=(2^{-1/2}-k_F s_F)/s_B. \tag{43}$$

Thus, specifying a chosen value of $k_F$ and C, and a choice of the ± signs in equation (41) allows us to put $$\beta_F M_F+\beta_B M_B+\beta_X X=(-C)^{-1}(\mathrm{sgn}\Gamma)|\gamma X\pm\delta W|, \tag{44b}$$

and $$\alpha_F M_F+\alpha_B M_B+\alpha_X X=(-C([\gamma X\pm\delta W] \tag{44a}$$

and equations (44) thus form a pair of simultaneous linear equations in $M_F$ and $M_B$, whose solution expresses $M_F$ and $M_B$ in the form of equations (27). Having solved equation (44) and $M_F$ and $M_B$, equation (32b) can then be used to express $C_F$ in the form of equation (27). Thus, given an arbitrary choice of the coefficients $k_F$ and C, a choice of the sign ± in equation (44), this completely solves the problem of finding a B-format solution of the form equation (27) to equation (25), provided only that the coefficients of $W^2$ and $X^2$ in equation (33) (which depend only on the choice of $k_F$) do not have the same sign.

We have implemented a numerical program to determine solutions to the B-format Ambisonic decoding equations (25) to (27) for 5-speaker decoders using the above solution algorithm, with input user parameters $k_F$, C and the sign ±. It has been found that the behaviour of the resulting solutions behaves in quite a singular way particularly as $k_F$ varies near the values for which the coefficients of $W^2$ or $X^2$ in equation (33) become equal to zero. It turns out that subjectively desirable solutions tend to be quite close to these singularity values, so that a first step in finding solutions is to determine what values of $k_F$ cause either coefficient of $W^2$ or $X^2$ in equation (33) to equal zero, and to ensure that either $k_F$ exceeds the larger such value or is smaller than the smaller such value in order that the signs of the $W^2$ and $X^2$ coefficients differ.

Exploring the values of $r_v$ and $r_E$ of different solutions, it has been found that the sign of ± in equations (44) should be chosen to be the upper sign, that $k_F$ should exceed the largest "critical value" for which one of the coefficients of $W^2$ and $X^2$ in equation (33) equals zero, and that C should be positive, typically between 0.5 and 2.

A low frequency solution with $r_v=1$ in all directions may be found most easily by noting that P has the form $$P=a_P W+b_P X \tag{45}$$

computed via equation (28a), and that $r_v=1$ for all directions if an only if $$a_P=2$$

and $$b_P=0. \tag{45b}$$

Thus a low frequency solution can be found by varying $k_F$ and C until equations (45b) are found to be satisfied; such values can be found by a numerical "hill climbing" or Newton's algorithm method. We have found that generally, there are to such $r_v=1$ solutions within the chosen desirable range of parameters $k_F$, C and ±, and that the one with larger $k_F$ generally gives larger values of $r_E$, and so is more desirable.

As explained earlier, finding a high frequency solution maximising $r_E$ is a more subjective thing, since $r_E$ cannot simultaneously be maximised in all directions. However, it has been found that typically, excellent results are obtained by choosing values of $k_E$ and C in the desirable range of values such that apapproximately equals $$a_P=8^{1/2}, \tag{45c}$$

which gives $r_v=0.7071$ for azimuths θ±90°. The choice of $b_P$ is less clear, but in general, $b_P$ at high frequencies is preferably chosen to be a negative coefficient such that for θ=0°, the outputs from the $L_B$ and $R_B$ speakers are close to or equal to zero, and at least 20 dB below the outputs from the frontal loudspeakers.

In doing designs of Ambisonic decoders for any given layout shape, (i.e. given $\phi_F$ and $\phi_B$), the values of $k_F$ and C are varied and for each such choice of values, it is desirable to compute $a_P$ and $b_P$, and also the coefficients in equations (27), and additionally Do compute the speaker feed gains, the energy gain E (in decibels), and the values of the psychoacoustic localisation parameters $r_v$, $\theta_v$, $r_E$, and $\theta_E$ for each encoded azimuth θ (selecting perhaps typical values say 0°, 15°, 45°, 60°, 90°, 135° and 180°—there is no need to examine negative azimuths, since the results are left/right symmetrical). One should, of course, have $\theta_v=\theta_E=\theta$, so such computations provide a useful check that the above algorithms have been computed correctly.

It is then possible to see how $r_E$ in particular varies with azimuth so as to select a good choice at high frequencies. However, satisfying equation (45c) and ensuring that $L_B=R_B=0$ for θ=0° provides a reasonable "automated" choice of high-frequency decoder. As with the $r_v=1$ low frequency solution, however, there are generally two such solutions, and the one with larger $k_F$ is generally found to have better $r_v$ and $r_E$ performance.

By way of example, in Table 1, we show the computed results of an analysis and decoder design for the case $\phi_F=45°$ and $\phi_B=50°$, both for the low frequency $r_v=1$ solution and the high frequency solution satisfying equation (45c) and having rear-speaker outputs equal to zero for θ=0. It will be noted that $r_E$ is larger at the front than at the back, and is usefully larger over a frontal stage than the typical value $r_E=0.7071$ encountered for prior art Ambisonic B-format decoders. However, this example also illustrates a typical defect encountered with 5-speaker and 6-speaker decoders designed according to the methods herein—namely that those directions for which $r_E$ is largest (and for which high frequency localisation is best) are reproduced with the lowest gain and those for which $r_E$ is smallest (and for which localisation is poorest) are reproduced with the highest gain. This is clearly undesirable.

In order to overcome this problem, it is necessary to use forward dominance to help reduce the gain of back sounds. Typically, the degree of forward dominance applied will be that which compensates for the difference in total energy gain between due front and due back sounds, at high frequencies, thereby giving equal gains in the front and back stages. The price paid for using forward dominance to compensate for gain variations in the decoder is that the reproduced azimuth $\theta_v=\theta_E$ no longer equals the encoded azimuth θ, but a modified azimuth θ' given by equations (4).

For forward dominance, this generally results in a narrower reproduced frontal stage. This is often desirable, since it helps to narrow the rather wide frontal Ambisonic stage to be a better match to the rather narrower frontal stage encountered with stereo reproduction systems using $n_F$ frontal stage channels and $n_B$ rear stage channels, and helps improve the match between the directions of sounds and associated visual images with HDTV.

In general, such additional forward dominance need not be implemented as a separate pre-decoder adjustment as shown in FIG. 10 (although such additional adjustment can be a useful listener control), but may preferably be implemented as altered coefficients $a_C$, $b_C$, $a_F$, $b_F$, $a_B$ and $b_B$ in the decoder matrices implementing equations (27)—there is no need to alter the Y coefficients since these are unaffected by forward dominance adjustments. The modified coefficients $a_C'$, $b_C'$, $a_F'$, $b_F'$, $a_B'$ and $b_B'$ may be derived from the computed coefficients $a_C$ to $b_B$ as follows: First compute the values (46a)

$$a_C+2^{1/2}b_C,\ a_C-2^{1/2}b_C, \tag{46a}$$

then multiply them respectively by $\lambda$ and $\lambda^{-1}$, giving $$c'=\lambda(a_C+2^{1/2}b_C),\ c''=(a_C=2^{1/2}b_c)/\lambda \tag{46b}$$

and finally compute the modified coefficients $$a_C'=\tfrac{1}{2}(c'+c'') \tag{46c}$$

$$b_C'=(c'-c'')/\sqrt{8} \tag{46d}$$

Identical computations are used to compute the other coefficients, simply by replacing the subscripts C in equation (46) either by F throughout or by B throughout.

In addition to using forward dominance with gain $\lambda^2$ to compensate for the difference between front and rear gain at high frequencies, it is also desirable to adjust the overall gain of (say) the high frequency decoder to match that of the low frequency decoder. Since in general the way gain varies with encoded azimuth will not be identical at low and high frequencies, in practice it is necessary to choose a particular azimuth (say $\theta_v$=45°) at which to make the gains of the low and high frequency decoders identical. Such an application of dominance and gain adjustment finishes the design procedure, and it is only necessary to check that for the average of the low and high frequency coefficients in equations (27), that the computed values of $\theta_V$ and $\theta_E$ do not deviate markedly from their values at low and high frequencies, to ensure that the decoder of FIG. 10 continues to perform well in the cross-over frequency range. It is found that $\theta_v$ does not vary in the cross-over range thanks to equations (30b) and (30c), and that $\theta_E$ differs from $\theta_v$ in that frequency range only by an insignificant fraction of a degree.

Very similar design methods are used for decoders for B-format decoders for six speakers, with a similar use of factorisation of two sides of an equation similar to equation (33). The main difference is that there is an additional free parameter $k_C$ (see equations (27)) in addition to $k_F$ and C, so that optimisation of decoder designs (including the $r_v$=1 low frequency case and the $a_p$=8½ high frequency case) involves trying to maximise $r_E$ over a wider range of design parameters, and in doing such designs it helps to have interactive computing facilities so that the way decoder performance alters as parameter values change can be examined interactively. Alternatively, by putting $k_C$=0, similar design methods to those used in the 5-speaker case can be used, with only relatively small changes in formulas from equations (28) onward. However, a 6-speaker decoder design with $k_C$=0 will not necessarily give the best possible performance.

APPENDIX B

Special Solutions

The complexity of the analytic solutions for general speaker layouts motivates a search for Ambisonic decoder solutions that are analytically simple, for 5 or 6 speakers. Such simple solutions exist for the special case, illustrated in FIGS. 6 and 8, for which the $L_B$, $L_F$, $R_F$ and $R_B$ loudspeakers lie on a rectangle. These special cases are of considerable interest in their own right. Here we give the results we have found, derived by methods involving factorisation similar to those used in the last section. We omit full details of the derivations of these results.

We introduce, for rectangle speaker layouts, the notations $$W_0=\tfrac{1}{2}(L_B+L_F+R_F+R_B)$$

$$X_0=\tfrac{1}{2}(-L_B+L_F+R_F-R_B)$$

$$Y_0=\tfrac{1}{2}(L_B+L_F-R_F-R_B)$$

$$F_0=\tfrac{1}{2}(-L_B+L_F-R_F+R_B) \tag{47}$$

The matrix equation (47) is a 4×4 orthogonal matrixing, and its inverse is $$L_B=\tfrac{1}{2}(W_0-X_0+Y_0-F(hd\ 0)$$

$$L_F=\tfrac{1}{2}(W_0+X_0+Y_0+F_0)$$

$$R_F=\tfrac{1}{2}(W_0+X_0-Y_0+F_0)$$

$$R_B=\tfrac{1}{2}(w_0-X_0-Y_0+F_0). \tag{48}$$

If we require that equations (30) hold for decoders for these layouts, it is found that the following solutions exist to the Ambisonic decoding equations:

7.1 4-Speaker Decoder

This solution has $$C_F=S_C=0 \text{ (giving no output from frontal speakers)}$$

$$F=0$$

$$W_0=k_1W+k_2X$$

$$X_0=X/(2^{1/2}\cos\phi)$$

$$Y_0Y/(2^{1/2}\sin\phi), \tag{49}$$

where preferred decoders generally have $k_2$=0, and where $$k_1=1 \tag{49b}$$

for the low frequency $r_v$=1 solution, and $$k_1=\sqrt{2} \tag{49c}$$

for the high frequency solution. This solution is the well-known Ambisonic decoder for a rectangular speaker layout described in the prior art Ambisonic literature.

7.2 $C_F=W_0$ solution

For both 5- and 6-speaker layouts, this solution is characterised by the equations $$F_0=S_C=0$$

$$C_F=W_0$$

$$Y_0=Y/(2^{1/2}\sin\phi) \tag{50a}$$

and, for the 5-speaker case $$X_0=[2^{1/2}X-C_F]/(2\cos\phi) \tag{50b}$$

or for the 6-speaker case $$X_0=[2^{1/2}X-2\cos\phi_C C_F]/(2\cos\phi). \tag{50c}$$

For the 5-speaker case, put $$w_0=\tfrac{2}{3}(k_1w+k_2x( \tag{50d}$$

and for the 6-speaker case, put $$w_0=\tfrac{1}{2}(k_1w+k_2X), \tag{50d}$$

where in both cases, the $r_v=1$ low frequency solution has $$k_1=1,\ k_2=0. \tag{50e}$$

This solution generally has very bad $r_E$ for rear azimuths, so is not generally recommended. The "best" values of $k_1$ and $k_2$ at high frequencies do not give such a good $r_E$ even for azimuth 0° sounds as solutions described below, and considerably worse $r_E$ at the rear.

7.3 Forward- and Backward Oriented Solutions 7.3.1 5-Speaker Case

This satisfies the equations $$\begin{aligned} C_F &= \frac{k\cos\phi}{C'\sin^2\phi}\left(\sqrt{2}\ W\pm\frac{1}{\cos\phi}\ X\right) \\ W_O &= \sqrt{2}\left(C'+\frac{k\cos\phi}{C'\sin^2\phi}\right)W\mp \\ &\quad\left(C'-\frac{k\cos\phi}{C'\sin^2\phi}\right)\frac{1}{\cos\phi}\ X+\frac{k}{2^{1/2}\cos\phi}\ X \\ X_O &= (2^{1/2}X-C_F)/(2\cos\phi) \\ Y_O &= Y/(2^{1/2}\sin\phi) \\ F_O &= kY/(2^{1/2}\sin\phi), \end{aligned} \tag{51}$$

where k is a free parameter and C' a nonzero free parameter, and the forward-oriented solution is that with the upper choice of signs in equations (51) and the backward-oriented solution is that with the lower choice of signs. The forward-oriented solution is found to be subjectively far more satisfactory than the backward-oriented solution or the $C_F=W_0$ solution, and superior to the 4-speaker solution across a broad frontal state of azimuths.

The low frequency $r_v=1$ solution can be shown to be given by the formulas $$k = \frac{1}{6\dfrac{\cos\phi}{\sin^2\phi}+\sqrt{\left(6\dfrac{\cos\phi}{\sin^2\phi}\right)^2+1}} \tag{51b}$$

$$C' = (1\pm k)/\sqrt{8}\ .$$

The value of our earlier parameters $k_F$ and $k_B$ is given in this case by $$k_F=\tfrac{1}{2}(1+k)/(2^{1/2}\sin\phi)$$

$$k_B=\tfrac{1}{2}(1-k)/(2^{1/2}\sin\phi). \tag{51c}$$

7.3.2. 6-Speaker Case

This special case satisfies $$\begin{aligned} S_C &= 0 \\ C_L &= C_R=C_F=(2\cos\phi_C)^{-1/2}\frac{k\cos\phi}{C'\sin^2\phi}\left(\sqrt{2}\ W\pm\frac{1}{\cos\phi}\ X\right) \\ W_O &= (2\cos\phi_C)^{-1/2}\left[\sqrt{2}\left(C'+\frac{k\cos\phi}{C'\sin^2\phi}\right)W\mp\right. \\ &\quad\left.\left(C'-\frac{k\cos\phi}{C'\sin^2\phi}\right)\frac{1}{\cos\phi}\ X\right]+\frac{k}{2^{1/2}\cos\phi}\ X \\ X_O &= (2^{1/2}X-2\cos\phi_C C_F)/(2\cos\phi) \\ Y_O &= Y/(2^{1/2}\sin\phi) \\ F_O &= kY/(2^{1/2}\sin\phi), \end{aligned} \tag{52}$$

where k and C' are free parameters, with $C'\neq 0$, and the forward-oriented solution is that with the upper choice of signs in equations (52), and the backward-oriented solution is that with the lower choice of signs. As in the 5-speaker case, the forward-oriented solution is found to be subjectively far more satisfactory than the backward oriented solution of the $C_F=W_0$ solution, and superior to the 4-speaker solution across a broad frontal stage of azimuths.

The low frequency $r_v=1$ solution can be shown to be given by the formulas $$k = \frac{1}{4\dfrac{\cos\phi}{\cos\phi_C\sin^2\phi}+\sqrt{\left(4\dfrac{\cos\phi}{\cos\phi_C\sin^2\phi}\right)^2+1}} \tag{52b}$$

$$C' = \tfrac{1}{2}(1\pm k)\ (\cos\phi_C)^{1/2}.$$

The rectangle cases dealt with in this Appendix, with $\phi=\phi_F=\phi_B$ are rather special in that the 4-speaker and $C_F=W_0$ solutions arise in the special case that the coefficients of both $W^2$ and $X^2$ in equation (33) (or its 6-speaker equivalent) equal zero. There is no counterpart to these special solutions in the non-rectangular case. However, the solutions considered in subsection 7.3 are special cases of the general solutions discussed in section 6, distinguished only by virtue of the relative simplicity of the form of the solution.

The fact that there are a number of quite distinct families of solutions for Ambisonic decoders for specific speaker layouts seems to be quite a general phenomenon. For example, there are two distinct solutions to panpot laws for three speaker stereo such that $\theta_v=\theta_E$. For speaker layouts even more elaborate than the five or six speaker layouts considered here, the structure of the space of solutions to the Ambisonic decoding equations can be quite complex, and a computer search among the solutions is required to identify those having the best $r_E$ behaviour.

APPENDIX C

Numerical Results

Table 2 lists a range of low and high frequency designs for 9 different 5-speaker layouts computed by the methods of appendices A and B, including forward dominance to compensate for front/rear gain variations and a gain adjustment of the high frequency decoder to ensure that it has the same gain at reproduced azimuths ±45° as the low frequency decoder. The cases $\phi_F$=35°, 45° and 55° and $\phi_F-\phi_F$=5°, 0° and −10° are listed. Because both the low and high frequency decoder matrices are chosen according to "objective" criteria, it is possible to use quadratic interpolation to derive 5-speaker Ambisonic decoders for other intermediate values of $\phi_F$ and $\phi_B-\phi_F$.

It has been found, however, that low frequency $r_v$=1 solutions do not exist for all angles $\phi_F$, $\phi_B$. For example, for the values $\phi_F$=35°, $\phi_B$=55°, there is no $r_v$=1 solution. In general, such low frequency solutions are found to exist for $\phi_B \leqq \phi_F$, but in general, $\phi_B$ cannot be more than about 10% or 15% larger than $\phi_F$ before an $r_v$=1 solution can no longer be found. In cases where the $r_v$=1 solution does not exist, one should seek to use a low frequency solution having as large a value of $r_v$ as is possible if this still gives a greater $r_v$ than at high frequencies.

The attainable value of $r_E$ at high frequencies for front stage sound is clearly enhanced by the use of the 5-speaker decoder, as seen in Table 2, as compared to similar 4-speaker rectangle decoders, thanks to the significant output from the $C_F$ speakers, with $r_E$ typically being increased from 0.7071 for a square layout to around 0.835 when a $C_F$ speaker is added. This almost halves the degree of image movement for front stage sounds. It will be seen that the value of $r_E$ at the sides and back is not drastically reduced, although the average value for $r_E$ over the whole 360° stage is not increased, and in fact is slightly reduced.

Thus, although the value of $r_E$ at the front is not brought up to ideal values very close to 1, the use of a 5-speaker Ambisonic decoder provides an improved image stability, as compared to previous designs, without giving an unacceptable loss of the rest of the surround sound 360° stage. Thus a 5-speaker Ambisonic decoder designed as here described matches TV use a great deal better than earlier decoders, and makes good use of just three transmission channels, although there is still a need for enhancing front-stage results by adding extra transmission channel signals.

The use of six speakers gives a further improvement of $r_E$ at the front, improving image stability further, while still giving reasonable values or $r_E$ (typically around 0.6) around the rest of the sound stage, as the Ambisonic decoder solutions listed in Table 3 illustrate. The degree of frontal stage image movement of the 6-speaker decoder is typically only 40% of that encountered with 4-speaker decoders. Where possible, the use of six speakers is preferable to five in terms of frontal image stability.

APPENDIX D

Six-Speaker B-Format Solutions to Ambisonic Decoding Equations

Here we outline the general solution to the 6-speaker Ambisonic decoding equations for B-format signals for the speaker layout of FIG. 9, analogous to the 5-speaker solution given in Appendix A. Except where explicitly defined otherwise, all notations are those of the above text and will not be redefined here.

Use the notations $c_c=\cos\phi_c$ and $S_C=\sin\phi_C$ and $t_C=\tan\phi_C$.

For the 6-speaker decoder, we assume that we seek solutions of the form of equations (26) and (27), where we assume that we start the design by assuming values of the parameters $k_C$ and $k_F$. Then the quantities P, $V_x$, $V_y$, E, $E_x$, $E_y$ are given by $$P=2(C_F+M_F+M_B)$$

$$V_x=2(c_C C_F+c_F M_F-c_B M_B)$$

$$V_y=2(s_C S_C+s_F S_F+s_B S_B)=2(s_C k_C+s_F k_F+s_B k_B)Y$$

$$E=2(C_F^2+S_C^2+M_F^2+S_F^2+M_B^2+S_B^2)$$

$$=2(C_F^2+M_F^2+M_B^2)+2(k_C^2+k_F^2+k_B^2)Y^2$$

$$E_x=2(C_F^2+S_C^2)c_C+2(M_F^2+S_F^2)c_F-2(M_B^2+S_B^2)c_B$$

$$E_y=4(s_c C_F S_C+s_F M_F S_F+s_B M_B S_B)$$

$$=4(s_C k_C C_F+s_F k_F M_F+s_B k_B M_B)Y. \quad \text{(A1)}$$

Putting by analogy with equations (30)

$$v_x=2^{1/2}X$$

$$v_y=2^{1/2}Y \quad \text{(A2)}$$

and ensuring that $\theta_{v=\theta E}=\theta$ by setting $$E_x V_y=E_y V_X, \quad \text{(A3)}$$

we get from equations (A1) by dividing by Y (and hence ignoring the very special solutions with Y=0)

$$C_F^2 c_C+M_F^2 c_F-M_B^2 c_C+(k_c^2 c_C+k_{Fm\ 2} c_F-k_B^2 c_B)Y^2=2(s_C k_C C_F+s_F k_F M_F+s_B k_B M_B)X. \quad \text{(A4)}$$

From equation (A2) and (A1), we have (A5)

$$C_F=(2^{-1/2}x-c_F M_F+c_B M_B)/c_C \quad \text{(A5)}$$

and also from equation (2) that $$Y^2=2W^2-X^2. \quad \text{(A6)}$$

Substituting these into equation (A4), we get $$(2^{-1/2}X-c_F M_F+c_B M_B)^2/c_C+c_F M_F^2-c_B M_B^2+(k_C^2 c_C+k_F^2 c_F-k_B^2 c_B)(2W^2-X^2)=2\{(2^{-1/2}X-c_F M_F+c_B M_B)k_C t_C+s_F k_F M_F+s_B k_B M_B)X. \quad \text{(A7)}$$

Note that from equations (A1) and (A2), particularly the equations for $V_y$, that $k_b$ is given in terms of $k_C$ and $k_F$ by $$k_B=(2^{-1/2}-s_C k_C-s_F k_F)/s_B. \quad \text{(A8)}$$

Then equation (A7) can be rearranged to give $$\left[c_F\left(\frac{c_F}{c_C}+1\right)M_F^2-\frac{2c_F c_B}{c_C}M_F M_B+c_B\left(\frac{c_B}{c_C}-1\right)M_B^2\right]+X\left[\left(-2^{1/2}\frac{c_F}{c_C}-2s_F k_F+2c_F k_C t_C\right)M_F+\right. \quad \text{(A9)}$$

-continued $$\left(2^{1/2}\frac{c_B}{c_C} - 2s_Bk_B - 2c_Bk_Ct_C\right)M_B\Bigg] + \alpha x^2 = \Delta W^2 + \Gamma X^2$$

where $\alpha$ is an arbitrary constant to be chosen so that the left hand side of equation (A9) factorises, and where $$\Delta=2(k_B^2c_B-k_c^2c_C-k_F^2c_F) \quad \text{(A10a)}$$

and $$\Gamma=\alpha-2/c_Ck_C^2c_C+k_F^2c_F-k_B^2c_B+2^{1/2}k_Ct_C. \quad \text{(A10b)}$$

The first square-bracketed term on the left hand side of equation (A9) can be factorised in the form $$(\alpha_FM_F+\alpha_BM_B)(\beta_FM_F+\beta_BM_B)$$

where $$\alpha_F=\beta_F=\sqrt{a} \quad \text{(A11a)}$$

$$\alpha_B=[-b-\sqrt{(b^2-ac)}]/\sqrt{a} \quad \text{(A11b)}$$

$$\beta_B[-b+\sqrt{(b^2-ac)}]/\sqrt{a} \quad \text{(A11c)}$$

where a, b and c are defined as the three quadratic coefficients in the first square-bracketed term of the left hand side of equation (A9), i.e.

$$a=c_F(1+c_F/c_C)$$

$$b=c_Fc_B/c_C$$

$$c=(-1+c_B/c_C)c_B. \quad \text{(A11d)}$$

the left hand side of equation (A9) can be factorised in the form $$(\alpha_FM_F+\alpha_BM_B+\alpha_XX)(\beta_FM_F+\beta_BM_B+\beta_XX) \quad \text{(A12)}$$

provided that a is chosen to equal $$\alpha=\alpha_X\beta_X \quad \text{(A13a)}$$

and that $\alpha_X$ and $\beta_X$ are the solutions to the pair of linear simultaneous equations $$\alpha_X\beta_F+\beta_X\alpha_F=-2^{1/2}c_F/c_C-2s_Fk_F+2c_Fk_Ct_C \quad \text{(A13b)}$$

and $$\alpha_X\beta_B+\beta_X\alpha_B=2^{1/2}(c_B/c_C)-2s_Bk_B-2c_Bk_Ct_C. \quad \text{(A13c)}$$

Having used equation (A13) to compute $\alpha_X$, $\beta_X$ and $\alpha$, one can then compute the numerical values of $\Gamma$ and $\Delta$.

In the very special case that $k_C$ and $k_F$ are such that $\Gamma=\Delta=0$, then we have that either $$\alpha_FM_F=\alpha_BM_B+\alpha_XX=0 \quad \text{(A14a)}$$

or $$\beta_FM_F+\beta_BM_B+\beta_XX=0, \quad \text{(A14b)}$$

and either of the conditions (A14a) or (A14b) is sufficient in that special case to ensure that the resulting decoder satisfies the $\theta=\theta_v=\theta_E$ equations. Otherwise, it is necessary to choose values of $k_C$ and $k_F$ such that $\Gamma$ and $\Delta$ do not have the same sign.

In that case, putting $\gamma=\sqrt{|\Gamma|}$ and $\delta=\sqrt{|\Delta|}$, equation (A9) can be put in the form $$(\alpha_FM_F+\alpha_BM_B+\alpha_XX)(\beta_FM_F+\beta_BM_B+\beta_XX)=(\gamma X\pm\delta W(\text{sgn}\Gamma)(\gamma X\pm\delta W) \quad \text{(A15)}$$

so that, for an arbitrary nonzero constant C, we can separate factors and put, for arbitrary choice of the sign $\pm$, $$\alpha_FM_F+\alpha_BM_B+\alpha_XX=(-C)(\gamma X\pm\delta W) \quad \text{(A15b)}$$

and $$\beta_FM_F+\beta_BM_B+\beta_XX=(-C)^{-1}(\text{sgn}\Gamma)(\gamma X\pm\delta W). \quad \text{(A15c)}$$

Thus equations (A15b) and (A15c) are a pair of simultaneous linear equations for $M_F$ and $M_B$ in terms of W and X, once one has chosen the constants $$k_C,\ k_F,\ C \text{ and } \pm. \quad \text{(A16)}$$

$C_F$ can be then derived from equation (A5), and $S_C$, $S_F$ and $S_B$ are given via equation (27), where $k_B$ is given by equation (A8).

This completes the derivation of a solution of the 6-speaker decoding equations for $\theta=\theta_v=\theta_E$ for a given speaker layout. In general, the best solutions, in terms of giving reasonable values of $r_E$, are again those with $\pm=+$ and C positive, but a search among the possible values of the parameters $k_C$ and $k_F$ is required. There is a one-parameter family of solutions which have $r_v=1$, and one will generally choose those solutions giving largest $r_E$ at low frequencies. In general, when searching among the parameters (A16) for a good high frequency solution, similar methods to those described in section 6 are used, and it is convenient to search among the values of the extra parameter $k_C$ in the 6-speaker case by setting $$k_C=Kk_F$$

where the constant K will generally be chosen to be positive and typically having a value in the general neighbourhood of $\phi_C/\phi_F$.

The need to search among the values of 3 continuous parameters (A16) for a good 6-speaker solution means that there is more choice in finding suitable equations for low and high frequency decoders for a given 6-speaker layout (provided that the layout is such as to give an $r_v=1$ solution), and the designer of a 6-speaker ambisonic decoder thus has some leeway in designing different tradeoffs for different tastes. In making such design tradeoffs, it is advisable to write a computer program that not only computes the decoder equations for a different values of the free parameters (A16), but which also prints out the values of the psychoacoustic localisation parameters $r_v$ and $r_E$ for azimuths around the circle, possibly in a graphical form, so that the effect of varying the decoder parameters (A16) can be seen in judging the final best tradeoffs.

For any given speaker layout, once a decoder design is arrived at, the forward dominance should be adjusted to minimise front/back reproduced gain variations, especially at higher frequencies, and the relative gain of the low and high frequency decoders should be adjusted so as to give broadly similar reproduced gain at all frequencies for at least front-stage sounds, as already described in connection with 5-speaker B-format decoders. This will yield the final 6-speaker B-format ambisonic decoder equations which typically may be implemented as in FIG. 10.

Such design procedures need to be done for a range of layout angles $\phi_C$, $\phi_F$ and $\phi_B$ in FIG. 9 likely to be used, so that the Ambisonic decoder can be adapted to the layout actually used in any particular situation, and adjustment means for the decoder matrices in FIG. 10 to allow this are desirably included.

In general, it is found that, for a given set of positions for the $L_B$, $L_F$, $R_F$, $R_B$ loudspeakers, a 6-speaker design will give a significantly larger $r_E$ across the frontal stage than a 5-speaker design, with only a small reduction of $r_E$, spread across the rear and side stages, in other directions. Thus, in general, 6-speaker designs are often better than 5-speaker designs in their subjective performance. The price paid for this improved localisation quality performance is the need to use larger amounts of forward dominance in 6-speaker designs (typically over 6 dB) to compensate reproduced gain variations than is needed for 5-speaker designs.

It is thought that this trend of improved frontal $r_E$ and the need for yet more forward dominance applies even more in the case of 7- or 8- speaker Ambisonic designs with yet more front stage speakers. For such designs, the number of free continuous parameters increases (5 for the 7 speaker case and 6 for the 8-speaker case), so that surveying the possible solutions to choose a "best" tradeoff becomes very time consuming, and preferably requires computer graphic aids to present psychoacoustic performance data in an easily assimable form.

TABLE 1

Example of 5-speaker Ambisonic decoder design according to the methods of section 6, for the speaker layout of FIG. 7 with $\phi_F = 45°$ and $\phi_B = 50°$, including values of psychoacoustic localisation parameters, overall energy gain in dB and speaker feed gains. High frequency front/back gain imbalance can be compensated by 3.893 dB forward dominance before decoding, and high frequency decoder can be matched in gain to low frequency decoder at azimuth $\Theta_V = \Theta_E = 45°$ by a 0.784 dB gain reduction of the high frequency decoder.

Low frequency decoder design 5-speakers, $\phi_F = 45°$, $\phi_B = 50°$
$k_F = 0.50527$, $C = 1.13949$
$C_F = 0.34190\ W + 0.23322\ X$, $M_F = 0.26813\ W + 0.38191\ X$, $S_F = 0.50527\ Y$
$M_B = 0.56092\ W - 0.49852\ X$, $S_B = 0.45666\ Y$
decoder performance:

| $\Theta = \Theta_V = \Theta_E$ | $r_V$ | dB | $r_E$ | $L_B$ | $L_F$ | $C_F$ | $R_F$ | $R_B$ |
|---|---|---|---|---|---|---|---|---|
| 0 | 1.0000 | 2.551 | 0.7494 | −0.1441 | 0.8082 | 0.6717 | 0.8082 | −0.1441 |
| 15 | 1.0000 | 2.641 | 0.7396 | 0.0471 | 0.9748 | 0.6605 | 0.6049 | −0.2872 |
| 45 | 1.0000 | 3.246 | 0.6807 | 0.5191 | 1.1553 | 0.5751 | 0.1448 | −0.3943 |
| 60 | 1.0000 | 3.645 | 0.6481 | 0.7677 | 1.1570 | 0.5068 | −0.0806 | −0.3509 |
| 90 | 1.0000 | 4.386 | 0.6017 | 1.2067 | 0.9827 | 0.3419 | −0.4464 | −0.0849 |
| 135 | 1.0000 | 5.065 | 0.5815 | 1.5161 | 0.3915 | 0.1087 | −0.6190 | 0.6028 |
| 180 | 1.0000 | 5.255 | 0.5832 | 1.2659 | −0.2720 | 0.0121 | −0.2720 | 1.2659 |

High frequency decoder design 5-speakers, $\phi_F = 45°$, $\phi_B = 50°$
$k_F = 0.54094$, $C = 0.93050$
$C_F = 0.38324\ W + 0.37228\ X$, $M_F = 0.44022\ W + 0.23386\ X$, $S_F = 0.54094\ Y$
$M_B = 0.78238\ W - 0.55322\ X$, $S_B = 0.42374\ Y$
decoder performance:

| $\Theta = \Theta_V = \Theta_E$ | $r_V$ | dB | $r_E$ | $L_B$ | $L_F$ | $C_F$ | $R_F$ | $R_B$ |
|---|---|---|---|---|---|---|---|---|
| 0 | 0.8158 | 3.046 | 0.8273 | 0 | 0.7709 | 0.9097 | 0.7709 | 0 |
| 15 | 0.8115 | 3.175 | 0.8148 | 0.1818 | 0.9577 | 0.8918 | 0.5617 | −0.1284 |
| 45 | 0.7806 | 4.029 | 0.7431 | 0.6529 | 1.2150 | 0.7555 | 0.1331 | −0.1946 |
| 60 | 0.7576 | 4.585 | 0.7059 | 0.9102 | 1.2681 | 0.6465 | −0.0569 | −0.1278 |
| 90 | 0.7071 | 5.620 | 0.6550 | 1.3816 | 1.2052 | 0.3832 | −0.3248 | 0.1831 |
| 135 | 0.6462 | 6.625 | 0.6306 | 1.7593 | 0.7473 | 0.0110 | −0.3346 | 0.9919 |
| 180 | 0.6240 | 6.938 | 0.6294 | 1.5648 | 0.1095 | −0.1432 | 0.1095 | 1.5648 |

TABLE 2a 5-speaker Ambisonic decoder design for $\phi_F = 35°$, $\phi_B = 25°$.

Low frequencies $\phi_F = 35°$, $\phi_B = 25°$
$k_F = 0.73675$, $C = 0.90593$, forward dominance = 3.8636 dB, gain = 0 dB
$C_F = 0.44310\ W + 0.45887\ X$, $M_F = 0.42349\ W + 0.24979\ X$,
$S_F = 0.73675\ Y$,
$M_B = 0.37979\ W - 0.32066\ X$, $S_B = 0.67324\ Y$.
High frequencies $\phi_F = 35°$, $\phi_B = 25°$
$k_F = 0.74762$, $C = 0.80803$, forward dominance = 3.8636 dB, gain = −0.4217 dB
$C_F = 0.49752\ W + 0.43912\ X$, $M_F = 0.54081\ W + 0.16195\ X$, $S_F = 0.71219\ Y$,
$M_B = 0.52758\ W - 0.37306\ X$, $S_B = 0.62728\ Y$.
psychoacoustic analysis

| | | low frequencies | | | high frequencies | | |
|---|---|---|---|---|---|---|---|
| $\Theta$ | $\Theta_V = \Theta_E$ | $r_V$ | $r_E$ | dB | $r_V$ | $r_E$ | dB |
| 0 | 0.00 | 1.0000 | 0.9009 | 3.820 | 0.8952 | 0.9120 | 3.868 |

TABLE 2a-continued 5-speaker Ambisonic decoder design for $\phi_F = 35°$, $\phi_B = 25°$.

| | | | | | | | |
|---|---|---|---|---|---|---|---|
| 15 | 12.03 | 1.0000 | 0.8319 | 4.130 | 0.8900 | 0.8512 | 4.162 |
| 45 | 36.69 | 1.0000 | 0.5424 | 5.705 | 0.8504 | 0.5912 | 5.699 |
| 60 | 49.61 | 1.0000 | 0.4399 | 6.379 | 0.8186 | 0.4988 | 6.388 |
| 90 | 77.36 | 1.0000 | 0.3447 | 6.837 | 0.7412 | 0.4190 | 6.983 |
| 135 | 125.29 | 1.0000 | 0.4405 | 4.820 | 0.6306 | 0.5192 | 5.699 |
| 180 | 180.00 | 1.0000 | 0.8384 | 1.586 | 0.5843 | 0.7567 | 3.868 |

TABLE 2b 5-speaker Ambisonic decoder design for $\phi_F = 35°$, $\phi_B = 35°$.

Low frequencies $\phi_F = 35°$, $\phi_B = 35°$
$k_F = 0.63701$, $C = 1.00206$, forward dominance = 4.1113 dB, gain = 0 dB
$C_F = 0.42521\ W + 0.34037\ X$, $M_F = 0.42380\ W + 0.33924\ X$,
$S_F = 0.63701\ Y$,
$M_B = 0.39173\ W - 0.34051\ X$, $S_B = 0.59579\ Y$.
High frequencies $\phi_F = 35°$, $\phi_B = 35°$
$k_F = 0.65584$, $C = 0.83708$, forward dominance = 4.1113 dB, gain = −0.5188 dB
$C_F = 0.46290\ W + 0.37054\ X$, $M_F = 0.53317\ W + 0.22733\ X$, $S_F = 0.61782\ Y$,
$M_B = 0.54101\ W - 0.38255\ X$, $S_B = 0.54351\ Y$.
psychoacoustic analysis

| | | low frequencies | | | high frequencies | | |
|---|---|---|---|---|---|---|---|
| $\Theta$ | $\Theta_V = \Theta_E$ | $r_V$ | $r_E$ | dB | $r_V$ | $r_E$ | dB |
| 0 | 0.00 | 1.0000 | 0.8686 | 3.928 | 0.8853 | 0.8915 | 3.865 |
| 15 | 11.86 | 1.0000 | 0.8251 | 4.118 | 0.8806 | 0.8527 | 4.057 |
| 45 | 36.21 | 1.0000 | 0.6122 | 5.155 | 0.8443 | 0.6633 | 5.127 |
| 60 | 49.00 | 1.0000 | 0.5227 | 5.626 | 0.8147 | 0.5847 | 5.642 |
| 90 | 76.56 | 1.0000 | 0.4317 | 5.899 | 0.7418 | 0.5102 | 6.103 |
| 135 | 124.62 | 1.0000 | 0.5225 | 4.175 | 0.6345 | 0.5916 | 5.127 |
| 180 | 180.00 | 1.0000 | 0.8087 | 1.860 | 0.5886 | 0.7561 | 3.865 |

TABLE 2c 5-speaker Ambisonic decoder design for $\phi_F = 35°$, $\phi_B = 40°$.

Low frequencies $\phi_F = 35°$, $\phi_B = 40°$
$k_F = 0.59675$, $C = 1.20337$, forward dominance = 4.2769 dB, gain = 0 dB
$C_F = 0.44167\ W + 0.22867\ X$, $M_F = 0.40882\ W + 0.41726\ X$,
$S_F = 0.59675\ Y$,
$M_B = 0.40080\ W - 0.35574\ X$, $S_B = 0.56756\ Y$.
High frequencies $\phi_F = 35°$, $\phi_B = 40°$
$k_F = 0.62175$, $C = 0.86543$, forward dominance = 4.2769 dB, gain = −0.5464 dB
$C_F = 0.44995\ W + 0.33464\ X$, $M_F = 0.52657\ W + 0.26606\ X$, $S_F = 0.58384\ Y$,
$M_B = 0.55191\ W - 0.39026\ X$, $S_B = 0.51202\ Y$.
psychoacoustic analysis

| | | low frequencies | | | high frequencies | | |
|---|---|---|---|---|---|---|---|
| $\Theta$ | $\Theta_V = \Theta_E$ | $r_V$ | $r_E$ | dB | $r_V$ | $r_E$ | dB |
| 0 | 0.00 | 1.0000 | 0.8471 | 4.153 | 0.8803 | 0.8812 | 3.949 |
| 15 | 11.75 | 1.0000 | 0.8150 | 4.283 | 0.8758 | 0.8511 | 4.098 |
| 45 | 35.89 | 1.0000 | 0.6431 | 5.017 | 0.8412 | 0.6946 | 4.956 |
| 60 | 48.58 | 1.0000 | 0.5619 | 5.358 | 0.8129 | 0.6244 | 5.384 |
| 90 | 76.03 | 1.0000 | 0.4681 | 5.519 | 0.7424 | 0.5523 | 5.773 |
| 135 | 124.17 | 1.0000 | 0.5185 | 4.060 | 0.6367 | 0.6136 | 4.956 |
| 180 | 180.00 | 1.0000 | 0.6908 | 2.339 | 0.5908 | 0.7368 | 3.949 |

TABLE 2d 5-speaker Ambisonic decoder design for $\phi_F = 45°$, $\phi_B = 35°$.

Low frequencies $\phi_F = 45°$, $\phi_B = 35°$
$k_F = 0.58727$, $C = 0.91902$, forward dominance = 3.1169 dB, gain = 0 dB
$C_F = 0.41964\ W + 0.45001\ X$, $M_F = 0.41347\ W + 0.27104\ X$,
$S_F = 0.58727\ Y$,
$M_B = 0.39285\ W - 0.36850\ X$, $S_B = 0.50882\ Y$.
High frequencies $\phi_F = 45°$, $\phi_B = 35°$
$k_F = 0.60353$, $C = 0.85140$, forward dominance = 3.1169 dB, gain = −0.58727 dB
$C_F = 0.48102\ W + 0.43822\ X$, $M_F = 0.51317\ W + 0.18754\ X$, $S_F = 0.55524\ Y$,
$M_B = 0.53400\ W - 0.37759\ X$, $S_B = 0.44965\ Y$.
psychoacoustic analysis

| | | low frequencies | | | high frequencies | | |
|---|---|---|---|---|---|---|---|
| $\Theta$ | $\Theta_V = \Theta_E$ | $r_V$ | $r_E$ | dB | $r_V$ | $r_E$ | dB |
| 0 | 0.00 | 1.0000 | 0.8214 | 3.834 | 0.8284 | 0.8535 | 3.844 |
| 15 | 12.56 | 1.0000 | 0.7946 | 3.953 | 0.8250 | 0.8306 | 3.957 |
| 45 | 38.19 | 1.0000 | 0.6495 | 4.627 | 0.7991 | 0.7045 | 4.619 |
| 60 | 51.52 | 1.0000 | 0.5809 | 4.946 | 0.7780 | 0.6439 | 4.960 |
| 90 | 79.77 | 1.0000 | 0.5077 | 5.108 | 0.7260 | 0.5785 | 5.277 |
| 135 | 127.27 | 1.0000 | 0.5872 | 3.817 | 0.6495 | 0.6300 | 4.619 |
| 180 | 180.00 | 1.0000 | 0.7678 | 2.354 | 0.6168 | 0.7273 | 3.844 |

TABLE 2e 5-speaker Ambisonic decoder design for $\phi_F = \phi_B = \phi = 45°$.

Low frequencies $\phi_F = \phi_B = \phi = 45°$
$k_F = 0.52936$, $C = 1.00589$, forward dominance = 3.5692 dB, gain = 0 dB
$C_F = 0.41221\ W + 0.36631\ X$, $M_F = 0.40810\ W + 0.36266\ X$,
$S_F = 0.52936\ Y$,
$M_B = 0.40697\ W - 0.39951\ X$, $S_B = 0.47064\ Y$.
High frequencies $\phi_F = \phi_B = \phi = 45°$
$k_F = 0.55707$, $C = 0.89149$, forward dominance = 3.5692 dB, gain = −0.7857 dB
$C_F = 0.46527\ W + 0.41346\ X$, $M_F = 0.49415\ W + 0.24746\ X$, $S_F = 0.50889\ Y$,
$M_B = 0.55584\ W - 0.39304\ X$, $S_B = 0.40463\ Y$.
psychoacoustic analysis

| | | low frequencies | | | high frequencies | | |
|---|---|---|---|---|---|---|---|
| $\Theta$ | $\Theta_V = \Theta_E$ | $r_V$ | $r_E$ | dB | $r_V$ | $r_E$ | dB |
| 0 | 0.00 | 1.0000 | 0.7771 | 4.169 | 0.8194 | 0.8349 | 4.027 |
| 15 | 12.24 | 1.0000 | 0.7645 | 4.213 | 0.8165 | 0.8226 | 4.083 |
| 45 | 37.28 | 1.0000 | 0.6869 | 4.468 | 0.7937 | 0.7472 | 4.426 |
| 60 | 50.36 | 1.0000 | 0.6432 | 4.579 | 0.7749 | 0.7046 | 4.612 |
| 90 | 78.31 | 1.0000 | 0.5860 | 4.535 | 0.7273 | 0.6457 | 4.791 |
| 135 | 126.08 | 1.0000 | 0.6113 | 3.637 | 0.6543 | 0.6435 | 4.426 |
| 180 | 180.00 | 1.0000 | 0.6810 | 2.839 | 0.6219 | 0.6742 | 4.027 |

TABLE 2f 5-speaker Ambisonic decoder design for $\phi_F = 45°$, $\phi_B = 50°$.

Low frequencies $\phi_F = 45°$, $\phi_B = 50°$
$k_F = 0.50527$, $C = 1.13949$, forward dominance = 3.8929 dB, gain = 0 dB
$C_F = 0.42505\ W + 0.29374\ X$, $M_F = 0.39694\ W + 0.43438\ X$,
$S_F = 0.50527\ Y$,
$M_B = 0.41574\ W - 0.42146\ X$, $S_B = 0.45666\ Y$.
High frequencies $\phi_F = 45°$, $\phi_B = 50°$
$k_F = 0.54094$, $C = 0.93050$, forward dominance = 3.8929 dB, gain = −0.7838 dB
$C_F = 0.46771\ W + 0.40469\ X$, $M_F = 0.48067\ W + 0.28334\ X$, $S_F = 0.49427\ Y$,
$M_B = 0.57135\ W - 0.40401\ X$, $S_B = 0.38718\ Y$.
psychoacoustic analysis TABLE 2f-continued 5-speaker Ambisonic decoder design for $\phi_F = 45°$, $\phi_B = 50°$.

| | | low frequencies | | | high frequencies | | |
|---|---|---|---|---|---|---|---|
| $\Theta$ | $\Theta_V = \Theta_E$ | $r_V$ | $r_E$ | dB | $r_V$ | $r_E$ | dB |
| 0 | 0.00 | 1.0000 | 0.7494 | 4.497 | 0.8158 | 0.8273 | 4.208 |
| 15 | 12.01 | 1.0000 | 0.7430 | 4.502 | 0.8131 | 0.8192 | 4.239 |
| 45 | 36.63 | 1.0000 | 0.6996 | 4.513 | 0.7918 | 0.7655 | 4.429 |
| 60 | 49.54 | 1.0000 | 0.6705 | 4.489 | 0.7740 | 0.7313 | 4.536 |
| 90 | 77.27 | 1.0000 | 0.6177 | 4.309 | 0.7285 | 0.6724 | 4.640 |
| 135 | 125.21 | 1.0000 | 0.5824 | 3.710 | 0.6567 | 0.6325 | 4.429 |
| 180 | 180.00 | 1.0000 | 0.5832 | 3.308 | 0.6240 | 0.6294 | 4.208 |

TABLE 2g 5-speaker Ambisonic decoder design for $\phi_F = 55°$, $\phi_B = 45°$.

Low frequencies $\phi_F = 55°$, $\phi_B = 45°$
$k_F = 0.50933$, $C = 0.92862$, forward dominance = 2.2870 dB, gain = 0 dB
$C_F = 0.39401\ W + 0.46686\ X$, $M_F = 0.39742\ W + 0.29732\ X$,
$S_F = 0.50933\ Y$,
$M_B = 0.41425\ W - 0.43739\ X$, $S_B = 0.40997\ Y$.
High frequencies $\phi_F = 55°$, $\phi_B = 45°$
$k_F = 0.53280$, $C = 0.89997$, forward dominance = 2.2870 dB, gain = −1.0511 dB
$C_F = 0.46072\ W + 0.46569\ X$, $M_F = 0.47680\ W + 0.21890\ 0.29732\ X$,
$S_F = 0.47207\ Y$,
$M_B = 0.54710\ W - 0.38686\ X$, $S_B = 0.33915\ Y$.
psychoacoustic analysis

| | | low frequencies | | | high frequencies | | |
|---|---|---|---|---|---|---|---|
| $\Theta$ | $\Theta_V = \Theta_E$ | $r_V$ | $r_E$ | dB | $r_V$ | $r_E$ | dB |
| 0 | 0.00 | 1.0000 | 0.7185 | 4.036 | 0.7509 | 0.7882 | 3.961 |
| 15 | 13.17 | 1.0000 | 0.146 | 4.044 | 0.7497 | 0.7834 | 3.976 |
| 45 | 39.91 | 1.0000 | 0.6889 | 4.087 | 0.7402 | 0.7507 | 4.071 |
| 60 | 53.69 | 1.0000 | 0.6724 | 4.095 | 0.7324 | 0.7286 | 4.125 |
| 90 | 82.48 | 1.0000 | 0.6463 | 4.021 | 0.7125 | 0.6881 | 4.178 |
| 135 | 129.42 | 1.0000 | 0.6412 | 3.675 | 0.6819 | 0.6564 | 4.071 |
| 180 | 180.00 | 1.0000 | 0.6516 | 3.435 | 0.6682 | 0.6515 | 3.961 |

TABLE 2h 5-speaker Ambisonic decoder design for $\phi_F = \phi_B = \phi = 55°$

Low frequencies $\phi_F = \phi_B = \phi = 55°$
$k_F = 0.47329$, $C = 1.01391$, forward dominance = 3.0674 dB, gain = 0 dB
$C_F = 0.39903\ W + 0.41484\ X$, $M_F = 0.38886\ W + 0.40426\ X$,
$S_F = 0.47329\ Y$,
$M_B = 0.42726\ W - 0.48618\ X$, $S_B = 0.38992\ Y$.
High frequencies $\phi_F = \phi_B = \phi = 55°$
$k_F = 0.51350$, $C = 0.94696$, forward dominance = 3.0674 dB, gain = −1.0292 dB
$C_F = 0.46402\ W + 0.48241\ X$, $M_F = 0.45136\ W + 0.28083\ X$, $S_F = 0.45613\ Y$,
$M_B = 0.58098\ W - 0.41082\ X$, $S_B = 0.31063\ Y$.
psychoacoustic analysis

| | | low frequencies | | | high frequencies | | |
|---|---|---|---|---|---|---|---|
| $\Theta$ | $\Theta_V = \Theta_E$ | $r_V$ | $r_E$ | dB | $r_V$ | $r_E$ | dB |
| 0 | 0.00 | 1.0000 | 0.6613 | 4.702 | 0.7455 | 0.7770 | 4.399 |
| 15 | 12.59 | 1.0000 | 0.6658 | 4.649 | 0.7445 | 0.7775 | 4.374 |
| 45 | 38.29 | 1.0000 | 0.6954 | 4.281 | 0.7369 | 0.7763 | 4.208 |
| 60 | 51.64 | 1.0000 | 0.7112 | 4.035 | 0.7304 | 0.7684 | 4.109 |
| 90 | 79.94 | 1.0000 | 0.7080 | 3.675 | 0.7135 | 0.7227 | 4.007 |
| 135 | 127.40 | 1.0000 | 0.5943 | 3.841 | 0.6857 | 0.6040 | 4.208 |
| 180 | 180.00 | 1.0000 | 0.5225 | 4.129 | 0.6725 | 0.5439 | 4.399 |

TABLE 2i 5-speaker Ambisonic decoder design for $\phi_F = 55°$, $\phi_B = 60°$

Low frequencies $\phi_F = 55°$, $\phi_B = 60°$
$k_F = 0.45806$, $C = 1.13695$, forward dominance = 3.6033 dB, gain = 0 dB
$C_F = 0.41789\ W + 0.36491\ X$, $M_F = 0.37845\ W + 0.48674\ X$,
$S_F = 0.45806\ Y$,
$M_B = 0.43420\ W - 0.52147\ X$, $S_B = 0.38321\ Y$.
High frequencies $\phi_F = 55°$, $\phi_B = 60°$
$k_F = 0.50892$, $C = 0.99169$, forward dominance = 3.6033 dB, gain = −0.9719 dB
$C_F = 0.47960\ W + 0.49722\ X$, $M_F = 0.42446\ W + 0.32011\ X$, $S_F = 0.45504\ Y$,
$M_B = 0.60440\ W - 0.42738\ X$, $S_B = 0.29965\ Y$.
psychoacoustic analysis

| | | low frequencies | | | high frequencies | | |
|---|---|---|---|---|---|---|---|
| $\Theta$ | $\Theta_V = \Theta_E$ | $r_V$ | $r_E$ | dB | $r_V$ | $r_E$ | dB |
| 0 | 0.00 | 1.0000 | 0.6259 | 5.227 | 0.7441 | 0.7742 | 4.732 |
| 15 | 12.21 | 1.0000 | 0.6337 | 5.142 | 0.7433 | 0.7766 | 4.688 |
| 45 | 37.21 | 1.0000 | 0.6890 | 4.531 | 0.7363 | 0.7872 | 4.392 |
| 60 | 50.27 | 1.0000 | 0.7231 | 4.116 | 0.7303 | 0.7843 | 4.212 |
| 90 | 78.20 | 1.0000 | 0.7300 | 3.550 | 0.7144 | 0.7295 | 4.024 |
| 135 | 125.99 | 1.0000 | 0.5327 | 4.093 | 0.6870 | 0.5581 | 4.392 |
| 180 | 180.00 | 1.0000 | 0.4251 | 4.694 | 0.6736 | 0.4745 | 4.732 |

TABLE 3a example of 6-speaker Ambisonic decoder design for $\phi = 45°$, $\phi_C = 15°$ and $k_C = 0$, without forward dominance or gain adjustments.

Low frequencies $\phi = 45°$, $\phi_B = 15°$
$k_F = 0.08476$, $C' = 0.53306$, $k_C = 0$
$C_F = 0.22811\ (W + X)$, $S_C = 0$, $M_F = 0.22932\ (W + X)$,
$S_F = 0.54238\ Y$
$M_B = 0.54187\ W - 0.458125\ X$, $S_B = 0.45762\ Y$.
High frequencies $\phi = 45°$, $\phi_B = 15°$
$k_F = 0.2$, $C' = 1.04567$, $k_C = 0$
$C_F = 0.27522\ (W + X)$, $S_C = 0$, $M_F = 0.48161\ W + 0.01765\ X$,
$S_F = 0.60000\ Y$,
$M_B = 0.85756\ W - 0.60639\ X$, $S_B = 0.40000\ Y$.
psychoacoustic analysis

| | low frequencies | | | high frequencies | | |
|---|---|---|---|---|---|---|
| $\Theta = \Theta_V = \Theta_E$ | $r_V$ | $r_E$ | dB | $r_V$ | $r_E$ | dB |
| 0 | 1.0000 | 0.8084 | 0.954 | 0.8540 | 0.8708 | 1.449 |
| 15 | 1.0000 | 0.7730 | 1.219 | 0.8431 | 0.8400 | 1.763 |
| 45 | 1.0000 | 0.6171 | 2.697 | 0.7687 | 0.7047 | 3.562 |
| 60 | 1.0000 | 0.5629 | 3.458 | 0.7180 | 0.6551 | 4.560 |
| 90 | 1.0000 | 0.5297 | 4.489 | 0.6194 | 0.6068 | 6.197 |
| 135 | 1.0000 | 0.6087 | 4.782 | 0.5187 | 0.6003 | 7.602 |
| 180 | 1.0000 | 0.6877 | 4.574 | 0.4860 | 0.6070 | 8.012 |

TABLE 3b 6-speaker ambisonic decoder design of table 3a with forward dominance and high-frequency gain adjustments.

Low frequencies $\phi = 45°$, $\phi_C = 15°$
$k = 0.08476$, $C' = 0.53306$, forward dominance = 6.5621 dB, gain = 0 dB
$C_F = 0.37049\ W + 0.30791\ X$, $S_C = 0$, $M_F = 0.37131\ W + 0.30859\ X$,
$S_F = 0.54238\ Y$, $M_B = 0.33040\ W - 0.34300\ X$, $S_B = 0.45762\ Y$.
High frequencies $\phi = 45°$, $\phi_C = 15°$
$k = 0.20000$, $C' = 1.04567$, forward dominance = 6.5621 dB, gain = −0.8300 dB
$C_F = 0.40502\ W + 0.33661\ X$, $S_C = 0$, $M_F = 0.37810\ W + 0.13692\ X$,
$S_F = 0.54532\ Y$, $M_B = 0.53421\ W - 0.37775\ X$, $S_B = 0.36355\ Y$.

We claim:

1. A decoder (2) for decoding directionally encoded audio signals for reproduction via a loudspeaker layout (4) over a listening area, comprising:

an input (21) for receiving the directionally encoded audio signals;

matrix means (22,23) for modifying said audio signals; and an output (24) for outputting the modified audio signal in a form suitable for reproduction via the loudspeakers;

the coefficients of said matrix means being such that at a predetermined listening position in the listening area the reproduced velocity vector direction and the reproduced energy vector directions are substantially equal to each other and substantially independent of frequency in a broad audio frequency range, characterised in that the gain coefficients of said matrix means (22,23) are such that the reproduced velocity vector magnitude $r_v$ of a decoded audio signal varies continuously in a predetermined manner with encoded sound direction at frequencies in the region of and above a predetermined middle audio frequency.

2. A decoder according to claim 1, in which the matrix means comprise:

first matrix means (22) operative at low audio frequencies below a cross-over frequency;

second matrix means (23) operative at high audio frequencies above the cross-over frequency, the second matrix means being different in effect to the first matrix means; and cross-over means (25) for effecting the transition around said cross-over frequency between the first matrix means and the second matrix means;

the broad frequency range in which the reproduced velocity vector direction and the reproduced energy vector direction are substantially equal to each other and substantially independent of frequency encompassing said cross-over frequency and preferably covering several octaves; and the reproduced velocity vector magnitude $r_v$ varies continuously in a predetermined manner with encoded sound direction at frequencies in the region of and above the cross-over frequency.

3. A decoder according to claim 1, wherein above the predetermined middle audio frequency the reproduced velocity vector magnitude $r_v$ is significantly larger for a frontal encoded direction than for a diametrically opposed rear encoded direction.

4. A decoder according to claim 2, wherein the cross-over frequency lies between 150 Hz and 1 kHz and preferably between 200 Hz and 800 Hz.

5. A decoder according to claim 2, wherein for all encoded sound directions the reproduced velocity vector magnitude $r_v$ is significantly larger below said cross-over frequency than above said cross-over frequency.

6. A decoder according to claim 2, wherein at frequencies below a cross-over transition region around said cross-over frequency, the reproduced velocity vector magnitude $r_v$ is substantially independent of encoded sound direction.

7. A decoder according to claim 6, wherein at frequencies below said cross-over transition region, the reproduced velocity vector magnitude $r_v$ substantially equals 1 for all encoded sound directions.

8. A decoder according to claim 1, wherein at frequencies above said predetermined middle audio frequency, the reproduced energy vector magnitude $r_E$ varies as a function of encoded sound direction in a broadly similar manner to the reproduced velocity vector magnitude $r_v$.

9. A decoder according to claim 1, wherein control means are provided for adjusting the gain coefficients of said matrix means to adapt the decoder for a plurality of loudspeaker layout arrangements, said control means modifying the gain coefficient so as to change components, including pressure components, of the reproduced audio signal.

10. A decoder according to claim 1, wherein said matrix means are arranged to decode the signal for reproduction over a loudspeaker layout having a greater number of reproduction loudspeaker across a frontal stage of directions than across a diametrically opposed rear stage of directions, the gain coefficients of the matrix means being such that at substantially all frequencies the reproduced energy vector magnitude $r_E$ of sounds encoded to be reproduced from vector directions within said frontal stage is significantly greater than the reproduced energy vector magnitude $r_E$ of sounds encoded to be reproduced from diametrically opposed vector directions within said rear stage.

11. A decoder according to claim 10, wherein said loudspeaker layout is substantially left/right symmetrical about a forward axis or plane through the predetermined listening position.

12. A decoder according to claim 11, wherein said loudspeaker layout comprises three loudspeakers disposed across said frontal stage and two loudspeakers disposed across a rear stage.

13. A decoder according to claim 11, wherein said loudspeaker layout comprises four loudspeakers disposed across said frontal stage and two loudspeakers disposed across a rear stage.

14. A decoder according to claim 1, in which the directionally encoded audio signals incorporate sound signal components representative of sound pressure and orthogonal directional sound velocity components.

15. A decoder according to claim 1, wherein said matrix means are arranged to decode directionally encoded audio signals comprising at least three linearly independent combinations of an omnidirectional signal W with uniform gain for all directions, and at least two directional signals X and Y, pointing in orthogonal directions, representing sounds encoded with figure-of-eight or cosine directional gain characteristics.

16. A decoder according to claim 15, wherein the reproduced pressure signal at the predetermined listening position is at all frequencies a linear combination $a_W W+b_W X$ of W and X whose relative proportions $a_W:b_W$ vary with frequency, the reproduced forward-pointing velocity signal at the predetermined listening position is at all frequencies a linear combination $a_X W+b_X X$ of W and X whose relative proportions $a_X:b_X$ do not vary with frequency, and the reproduced sideways-pointing velocity signal at the predetermined listening position is at all frequencies proportional to Y.

17. A decoder according to claim 1, wherein said matrix means are arranged to decode directionally encoded audio signals comprising two independent complex linear combinations of an omnidirectional signal W with uniform gain for all directions, and at least two directional signals X and Y, pointing in orthogonal directions, representing sounds encoded with figure-of-eight or cosine directional gain characteristics.

18. A decoder according to claim 17, wherein the gain coefficient of the matrix means are such that the reproduced pressure signal at the predetermined listening position is at all frequencies a linear combination $a_W W+b_W X+jc_W Y$ of W, X and Y, whose relative proportions $a_W:b_W$ vary with frequency, and the reproduced signal representing forward-pointing velocity at the predetermined listening position is at all frequencies a linear combination $a_X W+b_X X+jc_X Y$ of W, X and Y, and the reproduced signal representing sideways-pointing velocity at the predetermined listening position is at all frequencies a linear combination $-ja_Y W-jb_Y X+c_Y Y$ of W, X and Y, where the coefficients $a_W$, $b_W$, $c_W$, $a_X$, $b_X$, $c_X$, $a_Y$, $b_Y$ and $c_Y$ are real and where $j=\sqrt{(-1)}$ represents a broadband relative 90° phase difference.

19. A decoder according to claim 17, wherein the matrix means further comprise phase-amplitude matrix means arranged to produce at least three complex linear combinations $W_2$, $X_2$, $Y_2$, and preferably or optionally a fourth linear combination $B_2$, of two directionally encoded input signals such that $W_2$ and $X_2$ have directional gain of the form $a_2+b_2X+c_2jY$ for real gains $a_2$, $b_2$ and $c_2$ that may be different for $W_2$ and $X_2$ and where $Y_2$ and $B_2$ are respectively proportional to $jX_2$ and to $jW_2$ or to real linear combinations thereof, and wherein said signals are fed by cross-over means with matched phase responses to at least two amplitude matrix means corresponding to different frequency ranges in the audio band to provide modified audio signals at the output of the decoder.

20. A decoder according to claim 15, wherein the matrix means further comprise additional linear 20 matrix means arranged to apply an additional linear transformation so that the output reproduced vector directions are related to the input encoded vector directions according to a transformation of direction.

21. A decoder according to claim 20, wherein said transformation of directions is a Lorentz transformation.

22. A decoder according to claim 20, wherein the effect of said additional matrix transformation is to render the total reproduced energy gains of sounds encoded at the front and at the rear substantially equal.

23. A decoder according to claim 20, wherein said additional linear matrix transformation is implemented as a linear matrix acting on said directionally encoded signals or linear combinations thereof.

24. A decoder according to claim 20, wherein said additional linear matrix transformation is combined with said matrix means or said first and second matrix means.

25. A decoder according to claim 15, having at least three loudspeakers across a reproduced frontal stage, wherein said directionally encoded audio signals additionally comprise signals proportional to E and/or F, where E has a directional gain characteristic substantially equal to zero outside an encoded frontal stage of encoded directions and a gain proportional to a linear combination of W and X having a positive gain for sounds at the centre of the encoded frontal stage across a frontal stage of encoded directions; and F has a gain substantially proportional to that of Y across a frontal stage of encoded directions and a gain substantially proportional to that of −Y across a rear stage of encoded directions, and where the decoder incorporates means for adding E to and subtracting E from the signal components containing W and X so as to localize encoded frontal stage sounds more precisely in individual frontal stage loudspeakers and/or means for adding F to and subtracting F from signal components containing Y so as to reduce cross talk between reproduced front and rear sound stages.

26. A decoder according to claim 24, wherein E has a gain of opposite polarity for sounds at the edges of the encoded frontal stage than for sounds encoded towards the centre of the encoded frontal stage.

27. An audio system comprising:

a decoder;

a multiplicity of loudspeakers laid out around a listening area; and an amplifier for amplifying the output of the decoder to drive the loudspeakers;

the decoder decoding directionally encoded audio signals for reproduction via the loudspeaker layout over the listening area, the decoder comprising:

an input for receiving the directionally encoded audio signals;

matrix means for modifying said audio signals; and an output for outputting the modified audio signal in a form suitable for reproduction via the loudspeakers;

the coefficients of said matrix means being such that at a predetermined listening position in the listening area the reproduced velocity vector direction and the reproduced energy vector directions are substantially equal to each other and substantially independent of frequency in a broad audio frequency range, characterised in that the gain coefficients of said matrix means are such that the reproduced velocity vector magnitude $r_v$ of a decoded audio signal varies substantially with encoded sound direction at frequencies in the region of and above a predetermined middle audio frequency.

28. A system according to claim 27, in which the loudspeaker layout includes a greater number of reproduction loudspeakers across a frontal stage of directions and a lesser number of loudspeakers across a diametrically opposed rear stage of directions, and in which the gain coefficient of the matrix means of the decoder are such that at substantially all frequencies the reproduced energy vector magnitude $r_E$ of sounds encoded to be reproduced from vector directions within said frontal stage is significantly greater than the reproduced energy vector magnitude $r_E$ of sounds encoded to be reproduced from diametrically opposed vector directions within said rear stage.

29. A system according to claim 28, in which the loudspeaker layout is substantially left/right symmetrical about a forward axis or plane through the predetermined listening position.

30. A system according to claim 29, wherein said loudspeaker layout comprises three loudspeakers disposed across said frontal stage and two loudspeakers disposed across a rear stage.

31. A system according to claim 29, wherein said loudspeaker layout comprises four loudspeakers disposed across said frontal stage and two loudspeakers disposed across a rear stage.

32. An audio-visual system incorporating in its audio stages a decoder according to claim 1.

33. A method of decoding directionally encoded audio signals for reproduction via a loudspeaker layout over a listening area, comprising applying the encoded audio signal to matrix means arranged to decode the signal, and outputting the signal in a form suitable for subsequent reproduction via the loudspeakers, the coefficient of said matrix means being such that at a predetermined listening position in the listening area the reproduced velocity vector direction and the reproduced energy vector direction are substantially equal to each other and substantially independent of frequency in a broad audio frequency range, characterised in that the reproduced velocity vector magnitude $r_v$ of a decoded audio signal varies continuously in a predetermined manner with encoded sound direction at frequencies in the region of and above a predetermined middle audio frequency.

34. A method according to 33, in which low audio frequencies of the encoded audio signal below a predetermined cross-over frequency are decoded by first matrix means, and high audio frequencies above the crossover frequency are decoded by second matrix means different in effect to the first matrix means, the broad audio frequency range in which the reproduced velocity vector direction and the reproduced energy vector direction are substantially equal to each other and substantially independent of frequency encompassing the cross-over frequency; and the reproduced velocity vector magnitude $r_v$ varying substantially with encoded sound direction at frequencies in the region of and above the cross-over frequency.

35. A method of encoding and decoding an audio signal, in which the audio signal is encoded as at least three linearly independent combinations of an omnidirectional signal W with uniform gain for all directions and two directional signals X and Y pointing in orthogonal directions, the signals X and Y having figure-of-eight or cosinusoidal directional gain characteristics, and the signal is subsequently decoded by a method according to claim 33.

36. A method of encoding and decoding an audio signal according to claim 35, wherein the reproduced pressure signal at the predetermined listening position is at all frequencies a linear combination $a_W W+b_W X$ of W and X whose relative proportions $a_W:b_W$ vary with frequency, the reproduced forward-pointing velocity signal at the predetermined listening position is at all frequencies a linear combination $a_X W+b_W X$ of W and X whose relative proportions $a_X:b_X$ do not vary with frequency, and the reproduced sideways-pointing velocity signal at the predetermined listening position is at all frequencies proportional to Y.

37. A method of encoding and decoding an audio signal, in which the audio signal is encoded as two independent complex linear combinations of an omnidirectional signal W with uniform gain for all directions, and at least two directional signals X and Y, pointing in orthogonal directions representing sounds encoded with figure-of-eight or cosine directional gain characteristics, and the signal is subsequently decoded by a method according to claim 33.

38. A method of encoding and decoding according to claim 37, wherein the reproduced pressure signal at the predetermined listening position is at all frequencies a linear combination $a_W W+b_W X+jc_W Y$ of W, X and Y, whose relative proportions $a_W:b_W$ vary with frequency, and the reproduced signal representing forward-pointing velocity at the predetermined listening position is at all frequencies a linear combination $a_X W+b_X X+jc_X Y$ of W, X and Y, and the reproduced signal representing sideways-pointing velocity at the predetermined listening position is at all frequencies a linear combination $-ja_Y W-jb_Y X+c_Y Y$ of W, X and Y, where the coefficients $a_W$, $b_W$, $c_W$, $a_X$, $b_X$, $c_X$, $a_Y$, $b_Y$ and $C_Y$ are real and may be frequency-dependent and where $j=\sqrt{(-1)}$ represents a broadband relative 90° phase difference.

39. An audio-visual system incorporating in its audio stages an audio system according to claim 37.

* * * * *

UNITED STATES PATENT AND TRADEMARK OFFICE

CERTIFICATE OF CORRECTION

PATENT NO. : 5,757,927

DATED : May 26, 1998

INVENTOR(S) : Michael A. Gerzon, et al.

It is certified that error appears in the above-identified patent and that said Letters Patent is hereby corrected as shown below:

In the Title page, item 30 delete"92044853" and insert--92044858--.

Signed and Sealed this

First Day of September, 1998

*Attest:*

*Attesting Officer*

BRUCE LEHMAN

*Commissioner of Patents and Trademarks*